US009787032B1

(12) United States Patent
Talalayev et al.

(10) Patent No.: US 9,787,032 B1
(45) Date of Patent: Oct. 10, 2017

(54) CONNECTOR GROUND SPRINGS

(71) Applicant: Apple Inc., Cupertino, CA (US)

(72) Inventors: Anton Talalayev, San Jose, CA (US); George Tziviskos, San Jose, CA (US); Kevin M. Robinson, Cupertino, CA (US); Daniel A. Bergvall, San Jose, CA (US); Edward J. Cooper, Campbell, CA (US); Brett W. Degner, Menlo Park, CA (US); David H. Narajowski, Los Gatos, CA (US); Ari Miller, San Francisco, CA (US); Houtan R. Farahani, San Ramon, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/294,590

(22) Filed: Oct. 14, 2016

(51) Int. Cl.

| | |
|---|---|
| ***H01R 4/64*** | (2006.01) |
| ***H01R 13/648*** | (2006.01) |
| ***H01R 24/60*** | (2011.01) |
| ***H01R 13/629*** | (2006.01) |
| *H01R 107/00* | (2006.01) |

(52) U.S. Cl.
CPC ..... *H01R 13/648* (2013.01); *H01R 13/629* (2013.01); *H01R 24/60* (2013.01); *H01R 2107/00* (2013.01)

(58) Field of Classification Search
CPC ... H01R 4/64; H01R 13/65802; H01R 13/648
USPC ..... 439/92, 95
See application file for complete search history.

(56) References Cited

U.S. PATENT DOCUMENTS

| | | | | |
|---|---|---|---|---|
| 4,699,438 | A * | 10/1987 | Kikuta | H01R 13/6275 439/353 |
| 5,357,402 | A * | 10/1994 | Anhalt | G06K 7/0047 174/51 |
| 5,429,520 | A * | 7/1995 | Morlion | H01R 13/65802 439/108 |
| 5,984,697 | A * | 11/1999 | Moran | H01R 13/24 361/804 |
| 6,089,882 | A * | 7/2000 | Costello | H05K 5/0269 439/95 |
| 6,227,880 | B1 * | 5/2001 | Zhu | H01R 23/6873 439/607.01 |
| 6,457,982 | B1 * | 10/2002 | Ko | H01R 13/6485 439/946 |
| 2004/0018758 | A1 * | 1/2004 | Yoshinaga | H01R 23/68 439/92 |
| 2004/0166708 | A1 * | 8/2004 | Kiely | H01R 4/363 439/92 |
| 2007/0093092 | A1 * | 4/2007 | Fang | H05K 7/1418 439/95 |

(Continued)

*Primary Examiner* — Gary Paumen
(74) *Attorney, Agent, or Firm* — Kilpatrick Townsend & Stockton, LLP

(57) ABSTRACT

Ground springs for connector receptacles. The ground springs may protect circuitry in an electronic device from stray voltages when a connector insert is inserted into a connector receptacle housed in the electronic device. One example may have a contacting portion located such that when a connector insert is mated with the connector receptacle, the contacting portion of the ground spring electrically connects to a shield of the connector insert before a ground contact of the connector insert electrically connects to a signal contact on a tongue of the connector receptacle.

20 Claims, 40 Drawing Sheets

(56) References Cited

U.S. PATENT DOCUMENTS

2012/0051025 A1* 3/2012 Jol ..... G06F 1/1626
361/818

* cited by examiner

CONNECTOR GROUND SPRINGS

BACKGROUND

The number and types of electronic devices available to consumers have increased tremendously the past few years and this increase shows no signs of abating. Devices such as portable computing devices, tablet, desktop, and all-in-one computers, cell, smart, and media phones, storage devices, portable media players, navigation systems, monitors and other devices have become ubiquitous.

Power and data may be provided from one electronic device to another over cables that may include one or more wires, fiber optic cables, or other conductors. Connector inserts may be located at each end of these cables and may be inserted into connector receptacles in the communicating or power transferring electronic devices.

These connector inserts may have various contacts. For example, a Universal Serial Bus Type-C connector insert may have signal and power contacts on a top and bottom side of a recess. Additional ground contacts may be located between the signal and power contacts and a front opening of the recess. The additional ground contacts may be connected to a shield, wherein the shield is located around the signal and power contacts, and wherein the shield of the connector insert is arranged to fit in a corresponding connector receptacle.

These connector inserts may mate with corresponding connector receptacles that have a tongue arranged to fit in the recess in the connector insert. The connector receptacle tongue may support signal and power contacts to mate with the signal and power contacts of the connector insert. The connector receptacle tongue may also have ground contacts behind the signal and power contacts to mate with the ground contacts near the front of the connector insert.

As a connector insert is inserted into a corresponding connector receptacle, the ground contacts of the connector insert may form transitory electrical connections with the signal and power contacts on the connector receptacle tongue. These temporary electrical connections may produce stray voltages on the contacts. These stray voltages may damage circuits in the electronic device that are connected to these contacts.

Thus, what is needed are methods and structures that may protect circuitry in an electronic device from stray voltages when a connector insert is inserted into a connector receptacle housed in the electronic device.

SUMMARY

Accordingly, embodiments of the present invention may provide methods and structures that may protect circuitry in an electronic device from stray voltages when a connector insert is inserted into a connector receptacle housed in the electronic device.

An illustrative embodiment of the present invention may provide a ground spring for a connector receptacle. The ground spring may have a contacting portion located such that when a connector insert is mated with the connector receptacle, the contacting portion of the ground spring electrically connects to a shield of the connector insert before a ground contact of the connector insert electrically connects to a signal contact on a tongue of the connector receptacle.

An illustrative embodiment of the present invention may provide a device enclosure having a passage for a connector receptacle tongue. A first recess may be provided on a first side of the passage and a second recess may be provided on a second side of the passage. A first opening may join the first recess and the passage, while a second opening may join the second recess and the passage. The first and second recesses may be parallel. They may also be parallel to the passage, they may be orthogonal to the passage, or they may be oblique with the passage. Ground springs may be located in the first and second recesses such that they have portions at or in the first and second openings.

The ground springs in the first and second recesses may have various form factors. In an illustrative embodiment of the present invention, a ground spring may include a first open-tube portion. The first open-tube portion may be joined to a second open-tube portion by a U-shaped portion. The first open-tube portion may include a contacting portion that may be at an opening in the passage. In another illustrative embodiment of the present invention, a ground spring may include a first open-tube portion having a lance. The lance may be in an opening in the passage.

These and other embodiments of the present invention may include a ground spring having a first arm located in the first recess and a second arm located in the second recess. The first and second arms may be joined by a joining piece. The arms may terminate in contacting portions. The contacting portions may include a lance extending beyond a face. The lances may provide a durable contacting surface for the ground springs. The lances may be positioned to be in the first and second openings. The faces may be located in the first and second recesses, where walls having a controlled thickness separate the recesses from the tongue passage. The lances may have a controlled depth. Since the depth of the lance and the width of the wall are controlled, a depth of a lance into the recess may be controlled. This may help to avoid the presence of a tactile response that could otherwise cause confusion by giving the impression that an insertion has occurred before it actually has. The presence of the faces in the recesses may prevent the appearance of gaps between the lances and edges of the openings. The arms may be flexible, which may help to avoid binding between a lance and an edge of an opening. The arms may provide a limited force for the lance against a shield of a connector insert when the connector inserted into the connector receptacle. These ground springs may include a tab that is folded at a right angle to the joining piece. The tab may fit in a notch in the device enclosure.

These ground springs may include additional features. For example, a ground spring may include a tab to be inserted into a slot in an inside surface of the device enclosure. This may secure the ground spring in place during assembly and may limit movement of the ground spring during use. The ground spring may further include extensions for further stabilizing the ground spring relative to the device enclosure.

In these and other embodiments of the present invention, a connector receptacle tongue may include ground contacts on a top and bottom surface. These ground contacts may include tabs angled orthogonally to the surfaces of the connector receptacle tongue. An O-ring of conductive foam or other material may be placed between the tabs on the connector receptacle tongue and the joining piece of the ground spring, the extensions on the ground spring (if present), or both. An optional piece of conductive foam may be placed between the ground spring and an inside surface of the device enclosure. The tongue may be attached to, or formed as part of, a board portion, which may be fixed to the device enclosure or other structure associated with the device enclosure. This may fix the connector receptacle tongue, ring of conductive foam, ground spring, piece of conductive foam (if present), and device enclosure together.

In these and other embodiments of the present invention, a spring-biased cam may be used as a ground spring. The cam may be located in a recess and may have a contacting portion at an opening in a passage in a device enclosure. A spring may apply a force pushing the cam into the opening between the recess and the passage. Optional washers may be used to prevent binding and to align the contacting portion of the cam to the opening. A fastener may secure the cam, spring, and washers to the device enclosure.

In these and other embodiments of the present invention, two connector receptacles may be positioned near each other. These two connector receptacles may share a ground spring structure. For example, a shared ground spring may be positioned in a recess between passages for two connector receptacle tongues. The shared ground spring may include two contacting portions, where each contacting portion may be located in an opening between the recess and a passage for a connector receptacle tongue.

In these and other embodiments of the present invention, other types of ground springs may be used. For example, spheres or balls that are biased by springs may be used. Tabs, trim rings, springs, and other structures may be used as ground springs in these and other embodiments of the present invention.

In these and other embodiments of the present invention, ground springs may be located in openings in a passage for a connector receptacle tongue. These openings may be located in either or both lateral sides of the passage, in a top of the passage, in a bottom of the passage, in both a top and bottom of the passage, or other combination thereof.

While embodiments of the present invention may be useful in USB Type-C connector receptacles and their enclosures, these and other embodiments of the present invention may be used in other types of connector receptacles and their enclosures for different interfaces and their enclosures.

In various embodiments of the present invention, ground springs, ground contacts, device enclosures (when conductive), and other conductive portions of a connector receptacle may be formed by stamping, metal-injection molding, machining, micro-machining, 3-D printing, or other manufacturing process. The conductive portions may be formed of aluminum, ceramic, stainless steel, steel, copper, copper titanium, phosphor bronze, or other material or combination of materials. They may be plated or coated with nickel, gold, or other material. The device enclosures (when nonconductive), housings, and other nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The printed circuit boards, for example those used to form the tongues and boards, may be formed of FR-4 or other material.

Embodiments of the present invention may provide connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These connector receptacles may provide interconnect pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector receptacles that may be used to provide a reduced set of functions for one or more of these standards. In various embodiments of the present invention, these interconnect paths provided by these connector receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
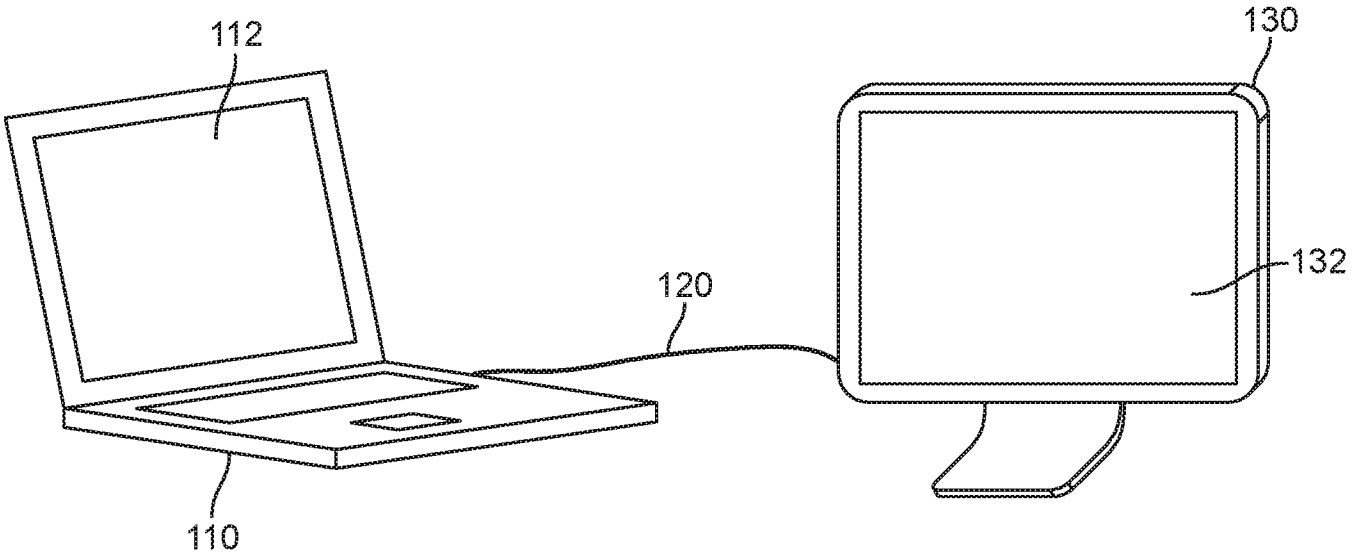
FIG. 1 illustrates an electronic system that may be improved by the incorporation of embodiments of the present invention.

FIG. 1 illustrates an electronic system that may be improved by the incorporation of an embodiment of the present invention. This figure, as with the other included figures, is shown for illustrative purposes and does not limit either the possible embodiments of the present invention or the claims.

This example illustrates monitor 130 that may be in communication with computer 110. Computer 110 may provide video or other data over cable 120 to monitor 130. Video data may be displayed on the video screen 132 of monitor 130. Computer 110 may similarly include a screen 112. In other embodiments the present invention, other types of devices may be included, and other types of data may be shared or transferred among the devices. For example, monitor 130 may be a monitor, an all-in-one computer, tablet computer, or other device. In these and other embodiments of the present invention, power may be shared between computer 110 and monitor 130 over cable 120.

Cable 120 may be one of a number of various types of cables. For example, it may be a Universal Serial Bus (USB) cable such as a USB Type-C cable, Thunderbolt, DisplayPort, Lightning, or other type of cable. Cable 120 may include compatible connector inserts (not shown) that plug into connector receptacles (not shown) on the computer 110 and monitor 130.

These connector inserts (not shown) may have various contacts. For example, a Universal Serial Bus Type-C connector insert may have signal and power contacts on a top and bottom side of a recess. Additional ground contacts may be located between the signal and power contacts and a front opening of the recess. The additional ground contacts may be connected to a shield, where the shield is around the signal and power contacts, and where the shield of the connector insert is arranged to fit in a corresponding connector receptacle.

These connector inserts (not shown) may mate with corresponding connector receptacles (not shown) that have a tongue arranged to fit in the recess in the connector insert. The connector receptacle tongue may have signal and power contacts to mate with the signal and power contacts of the connector insert. The connector receptacle tongue may also have ground contacts behind the signal and power contacts to mate with the ground contacts near the front of the connector insert.

As a connector insert is inserted into a corresponding connector receptacle, the ground contacts of the connector insert may form transitory electrical connections with the signal and power contacts on the connector receptacle tongue. These transitory electrical connections may produce stray voltages on the contacts. These stray voltages may damage circuits in the electronic device that are connected to these contacts.

Accordingly, embodiments of the present invention may provide methods and structures that may protect circuitry in an electronic device from stray voltages when a connector insert is inserted into a connector receptacle housed in the electronic device. An illustrative embodiment of the present invention may provide a ground spring for a connector receptacle. The ground spring may have a contacting portion located such that when a connector insert is mated with the connector receptacle, the contacting portion of the ground spring electrically connects to a shield of the connector insert before a ground contact of the connector insert electrically connects to a signal contact on a tongue of the connector receptacle. How these transitory connections are formed is shown in the following figure.

Figure 2:
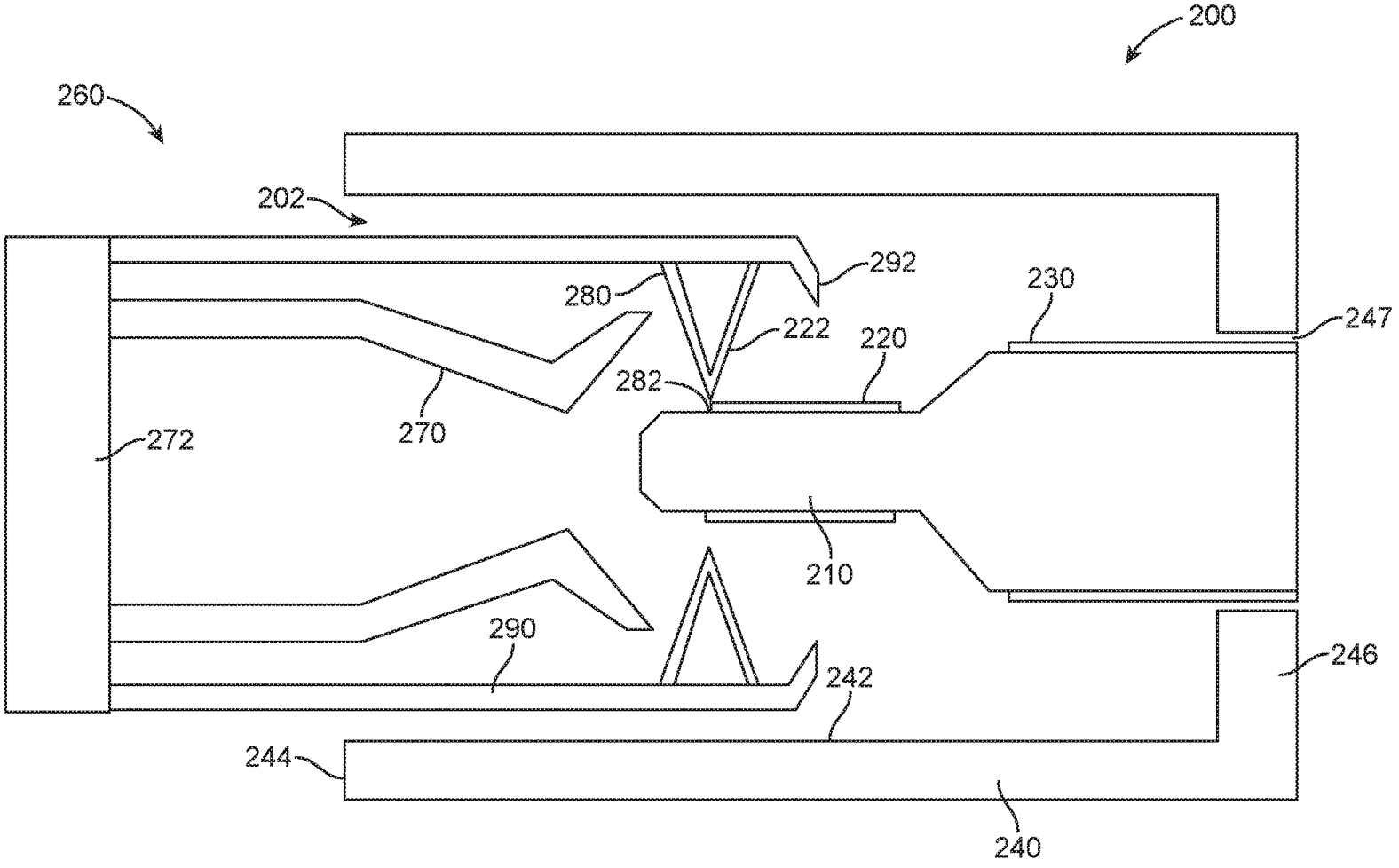
FIG. 2 illustrates a connector insert that is being inserted into a connector receptacle.

FIG. 2 illustrates a connector insert being inserted into a connector receptacle. In this example, connector insert 260 and connector receptacle 200 may be Universal Serial Bus Type-C connectors, though the underlying concepts here may be applicable to other types of connectors as well.

In this example, connector insert 260 may be inserted from left to right into connector receptacle 200. Connector insert 260 may include power and signal contacts 270 supported by housing 272. Power and signal contacts 270 may be surrounded by shield 290. Ground contacts 280 may be electrically connected to shield 290.

Connector receptacle 200 may include passage 202 in device enclosure 240 for connector receptacle tongue 210. Connector receptacle tongue 210 may support power and signal contacts 220 (or simply signal contacts 220) and ground contacts 230. Connector receptacle tongue 210 may emerge through opening 247 in rear surface 246 of device enclosure 240.

In a fully mated state, ground contacts 280 of connector insert 280 may physically and electrically connect to ground contacts 230 of connector receptacle 200. In the fully mated state, power and signal contacts 270 may physically and electrically connect to power and signal contacts 220 on connector receptacle tongue 210.

While connector insert 260 is being inserted into connector receptacle 200, ground contacts 280 of connector insert 260 may contact one or more signal contacts 220 on connector receptacle tongue 210. This transitory connection typically causes no damage. For example, often a ground potential for connector insert 260 may be very close to a ground potential for connector receptacle 200. In such a case, a transitory grounding of one or more signal contacts 220 on connector receptacle tongue 210 by ground contacts 280 of connector insert 260 may not create a sufficient voltage to damage circuitry connected to signal contacts 220.

In some circumstances, before mating, a ground potential for connector insert 260 may be quite different than a ground potential for connector receptacle 200. This may be particularly true where connector insert 260 is connected to an ungrounded charger. In this case, sufficient voltages may exist between a ground potential on ground contacts 280 and a ground of connector receptacle 202 to damage circuitry connected to signal contacts 220 during insertion.

Accordingly, embodiments of the present invention may provide a ground spring (not shown) for connector receptacle 200. This ground spring may form an electrical connection with shield 290 of connector insert 260. The ground spring may be positioned such that an electrical connection is made between the ground spring and shield 290 before an edge 282 of ground contact 280 reaches a front edge 222 of one or more signal contacts 220. In this way, the ground potentials between connector insert 260 and connector receptacle 200 may be equalized before circuitry connected to signal contacts 220 may be damaged.

In this example, a ground spring may be located at a position between locations 242 and 244 on an inside surface of device enclosure 240. Location 242 may be the location where a leading edge 292 of shield 290 is positioned in device enclosure 240 when an edge 282 of ground contact 280 reaches a leading edge 222 of one or more signals contacts 220. Location 244 may be a front edge of device enclosure 240. When a ground spring is located between these locations, it may form an electrical connection with shield 290 before edge 282 of ground contact 280 reaches leading edge 222 of one or more signal contacts 220.

Various USB Type-C connector inserts may have a portion of leading edge 292 formed of plastic or other nonconductive material. Accordingly, in these and other embodiments of the present invention, a ground spring may be located closer to location 244 (between locations 242 and 244) in order to compensate for the plastic tip. Also, a connector insert may be somewhat tilted or rotated, or both, upon insertion. A ground spring may be located closer to location 244 in order to compensate for this tilt and rotation.

In various embodiments of the present invention, one, two, or more than two ground springs may be included as part of connector receptacle.

In USB Type C connectors, a retention spring (not shown) on connector insert 220 may engage a notch (not shown) in a side of tongue 210. This engagement may generate a tactile response indicating that a connection between connector insert 260 and connector receptacle 200 has been formed. Accordingly, it may be desirable to avoid such a tactile response when shield 290 of connector insert 260 engages a ground spring on an inside surface of device enclosure 240. That is, such a tactile response may provide a misleading indication that a connection has been made between connector insert 260 and connector receptacle 200. Accordingly, embodiments of the present invention may provide ground springs that provide a minimal amount of force when engaged by shield 290 of connector insert 260. This may help to avoid or limit a tactile response before a connection has been made and may help to avoid confusion. Examples of these ground springs are shown in the following figures.

Figure 3:
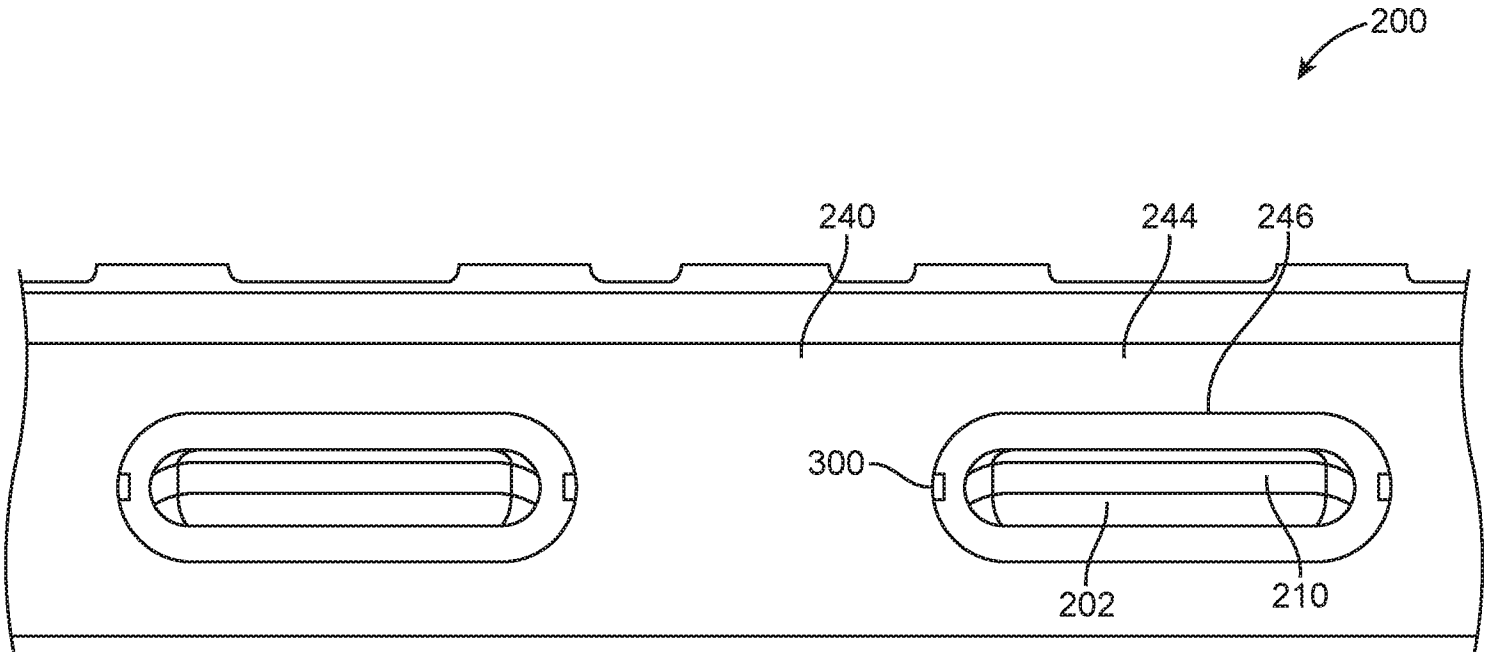
FIG. 3 illustrates a front view of a pair of connector receptacles according to an embodiment of the present invention.

FIG. 3 illustrates a front view of a pair of connector receptacles according to an embodiment of the present invention. In this example, each connector receptacle 200 may include tongue 210 located in passage 202 in device enclosure 240. Tongue 210 may emerge through rear surface 246 of device enclosure 240. Device enclosure 240 may have a front surface 240. Ground springs 300 may be located in sides of passage 202. Ground springs 300 may be located on lateral sides of tongue 210 as shown. Ground springs 300 may be located on either or both lateral sides, on a top side, bottom side, or both a top and bottom side of passage 202, or any combination thereof. Again, as a connector insert (not shown) is inserted into connector receptacle 200, ground springs 300 may engage a shield of the connector insert. This may equalize ground potentials between the connector insert and connector receptacle 200 before a ground contact of the connector insert engages a signal contact (not shown) on tongue 210.

These ground springs 300 may be located in various openings in an inside surface of passage 200 in device enclosure 240. Examples of such openings are shown in the following figures.

Figure 4:
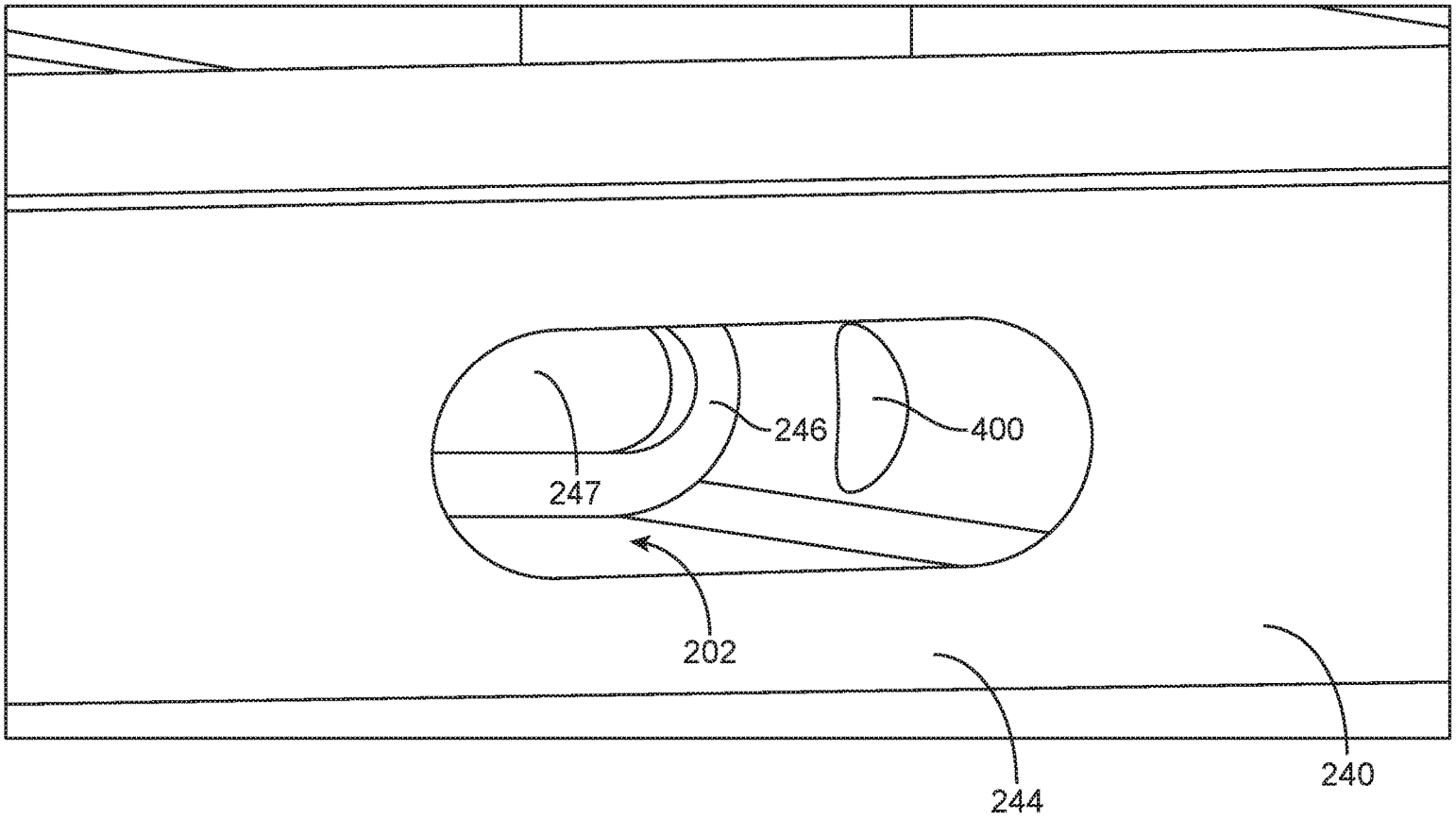
FIG. 4 illustrates a portion of a device enclosure according to an embodiment of the present invention.

FIG. 4 illustrates a portion of a device enclosure according to an embodiment of the present invention. In this example, passage 202 may be formed in device enclosure 240. Passage 202 may have a rear surface 246 and a front surface 244. Rear surface 246 may include opening 247, through which connector receptacle tongue 210 (shown in FIG. 3) may be inserted. Opening 400 may be located in an inside surface of passage 202. Opening 400 may provide access for a ground spring (not shown). In this example, opening 400 may be longer in a vertical direction that is orthogonal to tongue 210. In these and other embodiments of the present invention, an opening may be longest in an angle that is oblique to tongue 210. An example is shown in the following figure.

Figure 5:
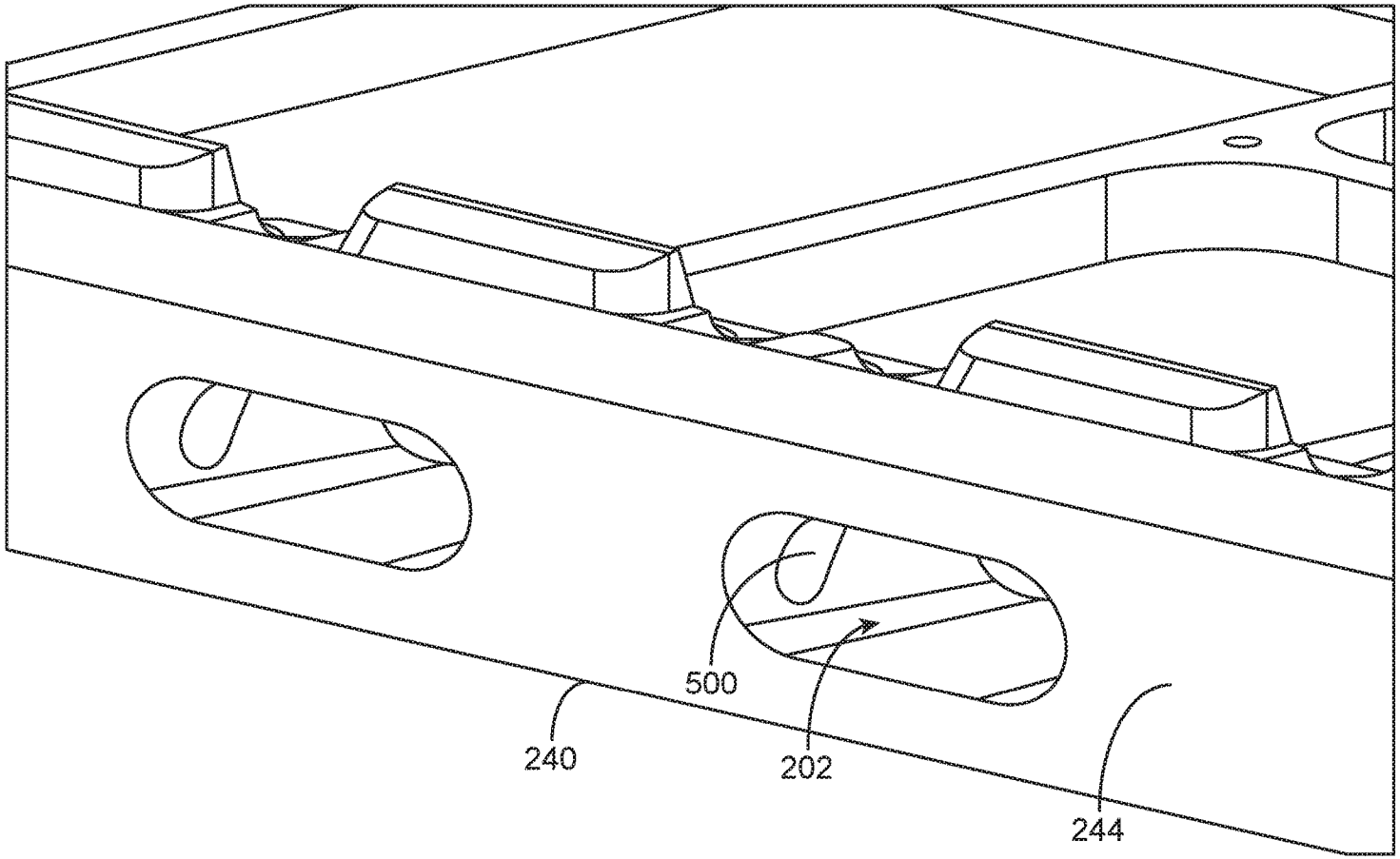
FIG. 5 illustrates a portion of another device enclosure according to an embodiment of the present invention.

FIG. 5 illustrates a portion of another device enclosure according to an embodiment of the present invention. In this example passage 202 may be formed in device enclosure 240. Passage 202 may have rear surface 246 (shown in FIG. 4) and front surface 244. Opening 500 may be located in an inside surface of passage 202. Opening 500 may provide access to a ground spring (not shown). In these and other embodiments of the present invention, opening 500 may be longest in an angle that is oblique to tongue 210. An example of a ground spring that may be used as ground spring 300 and that may have a portion located in openings 400 (shown in FIG. 4) or 500 is shown in the following figure.

Figure 6:
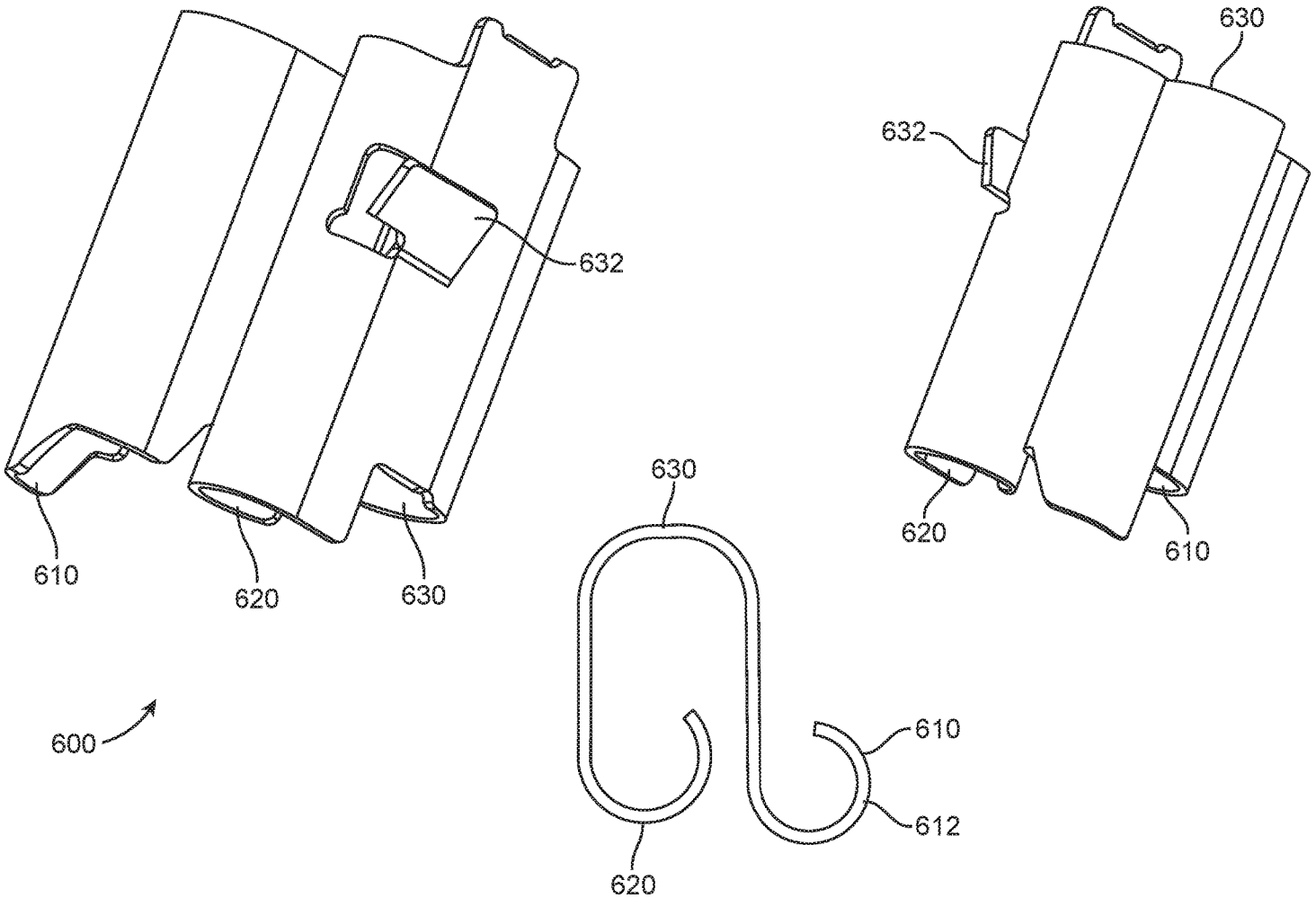
FIG. 6 illustrates a ground spring according to an embodiment of the present invention.

FIG. 6 illustrates a ground spring according to an embodiment of the present invention. Ground spring 600 may be used as ground spring 300 or as other ground springs in other embodiments of the present invention. Ground spring 600 may include a first open-tube portion 610. First open-tube portion 610 may include contacting surface 612. Contacting surface 612 may sit in an opening, such as opening 400 (shown in FIG. 4) or 500 (shown in FIG. 5), in passage 202 in device enclosure 240 (shown in FIGS. 4 and 5). Ground spring 600 may further include a second open-tube portion 620 joined to first open-tube portion 610 by U-shaped portion 630. Ground spring 600 may further include tab 632. Tab 632 may act as a barb to hold ground spring 600 in place in device enclosure 240.

In various embodiments of the present invention, ground spring 600 may be located in a recess in device enclosure 240 (shown in FIG. 4) and contacting surface 612 may be located in opening 400 (shown in FIG. 4). An example is shown in the following figure.

Figure 7:
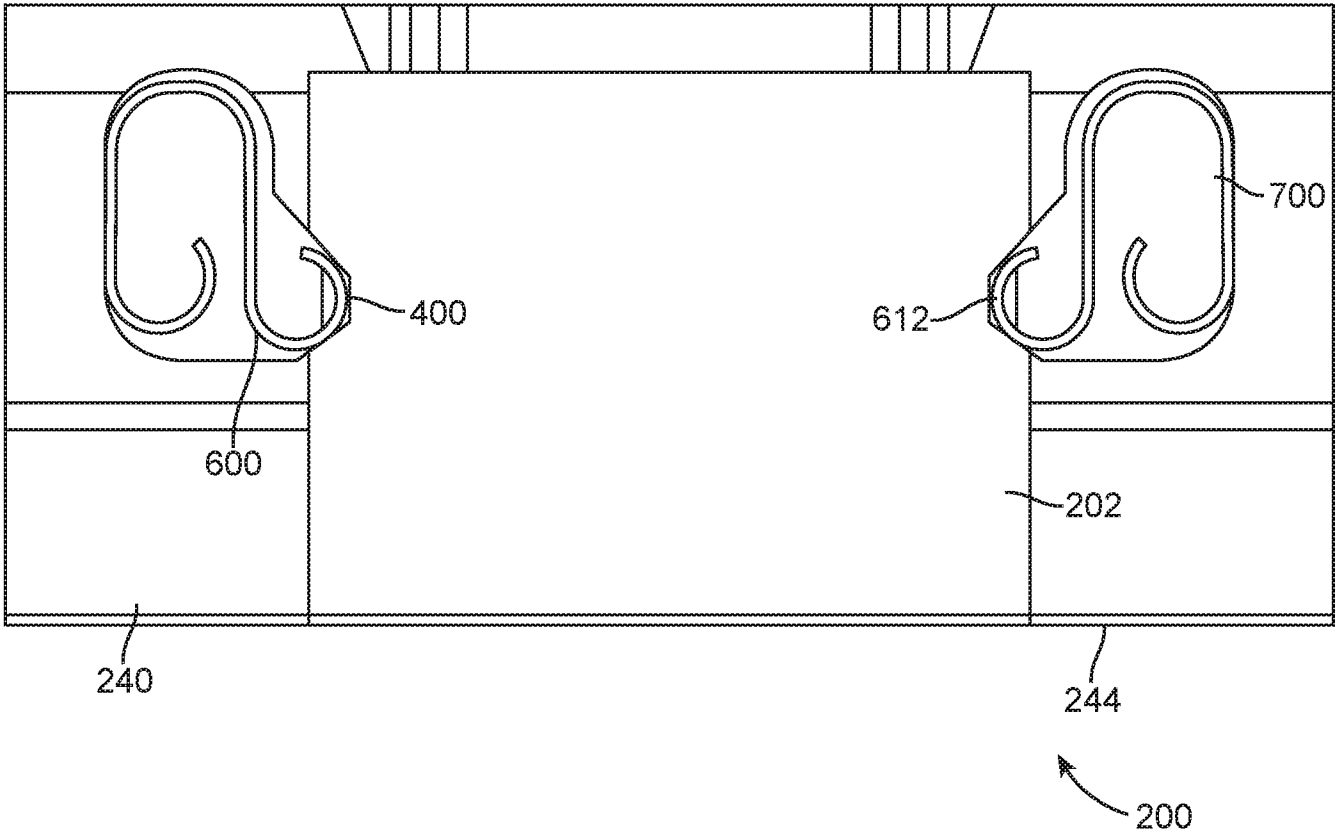
FIG. 7 illustrates a top cutaway view of a connector receptacle according to an embodiment of the present invention.

FIG. 7 illustrates a top cutaway view of a connector receptacle according to an embodiment of the present invention. In this example, tongue 210 (shown in FIG. 3) may be located in passage 202 in device enclosure 240. Ground springs 600 may be located in recesses 700 in device enclosure 240. Openings 400 may connect recesses 700 to passage 202. Contacting portions 612 of ground springs 600 may be located in openings 400 in an inside surface of passage 202 in device enclosure 240. Contacting portions 612 of ground springs 600 may physically and electrically connect to a shield of a connector insert (not shown) when the connector insert is inserted into connector receptacle 200.

In this example, recesses 700 may be formed in a substantially vertical direction such that recesses 700 are orthogonal to passage 202. The result is that openings 400 may be longest in a direction that is orthogonal to tongue 210. This also means that ground springs 600 may be orthogonal to tongue 210 (shown in FIG. 3).

In some circumstances it may be desirable to move the opening and ground spring 600 towards surface 244 of device enclosure. This may help to ensure that ground spring 600 engages a shield of a connector insert before a ground contact on the connector insert engages a signal contact 220 on tongue 210 (shown in FIG. 2). This may be achieved by tilting or angling ground springs 600 and their recess relative to passage 202 and tongue 210.

Accordingly, in various embodiments of the present invention, ground spring 600 may be located in a recess in device enclosure 240 (shown in FIG. 5) and contacting surface 612 may be located in opening 500 (shown in FIG. 5). An example is shown in the following figure.

Figure 8:
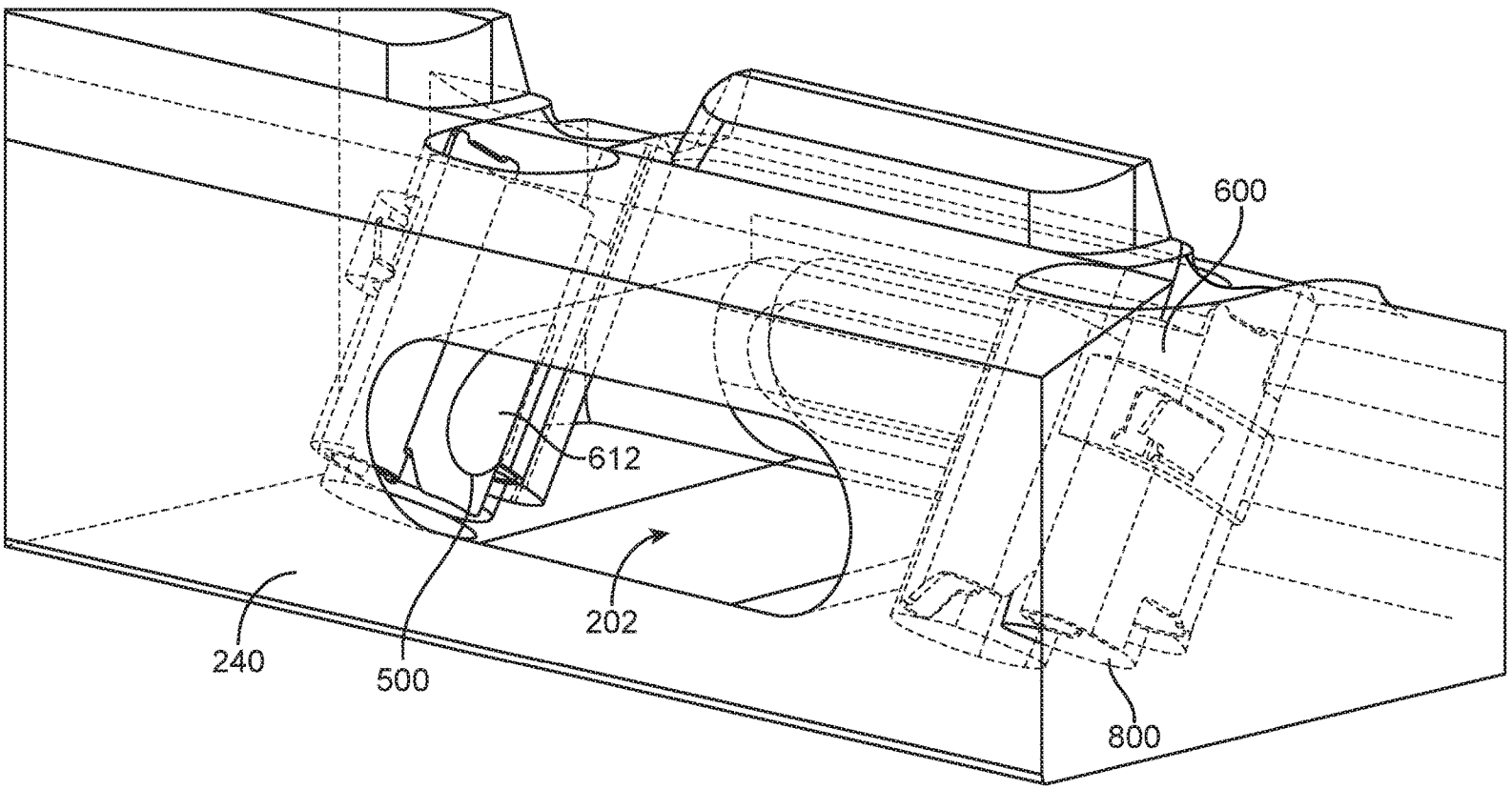
FIG. 8 illustrates a transparent view of a portion of a connector receptacle according to an embodiment of the present invention.
Figure 18:
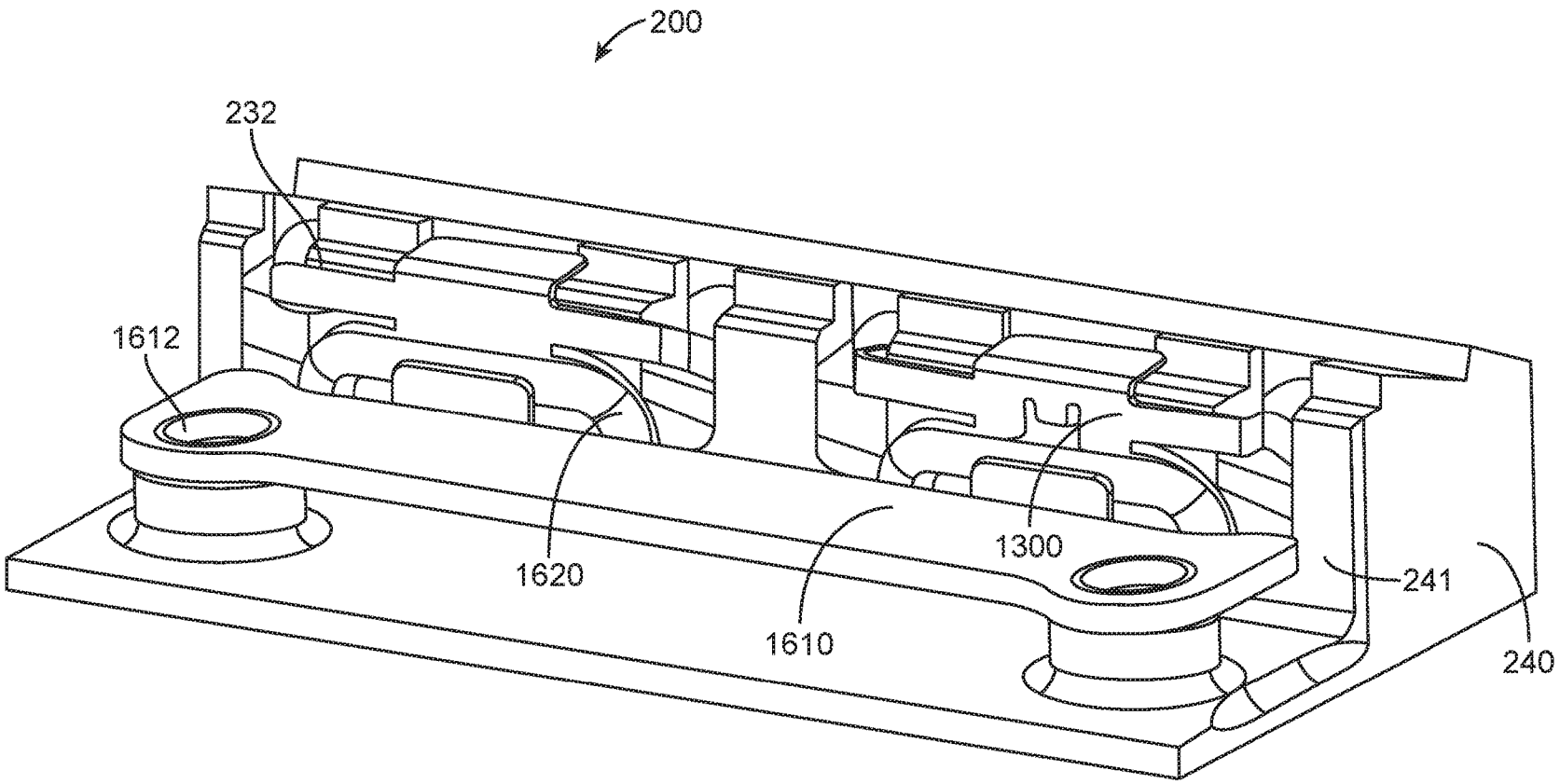
FIG. 18 illustrates an assembled pair of connector receptacles according to an embodiment of the present invention.
Figure 23:
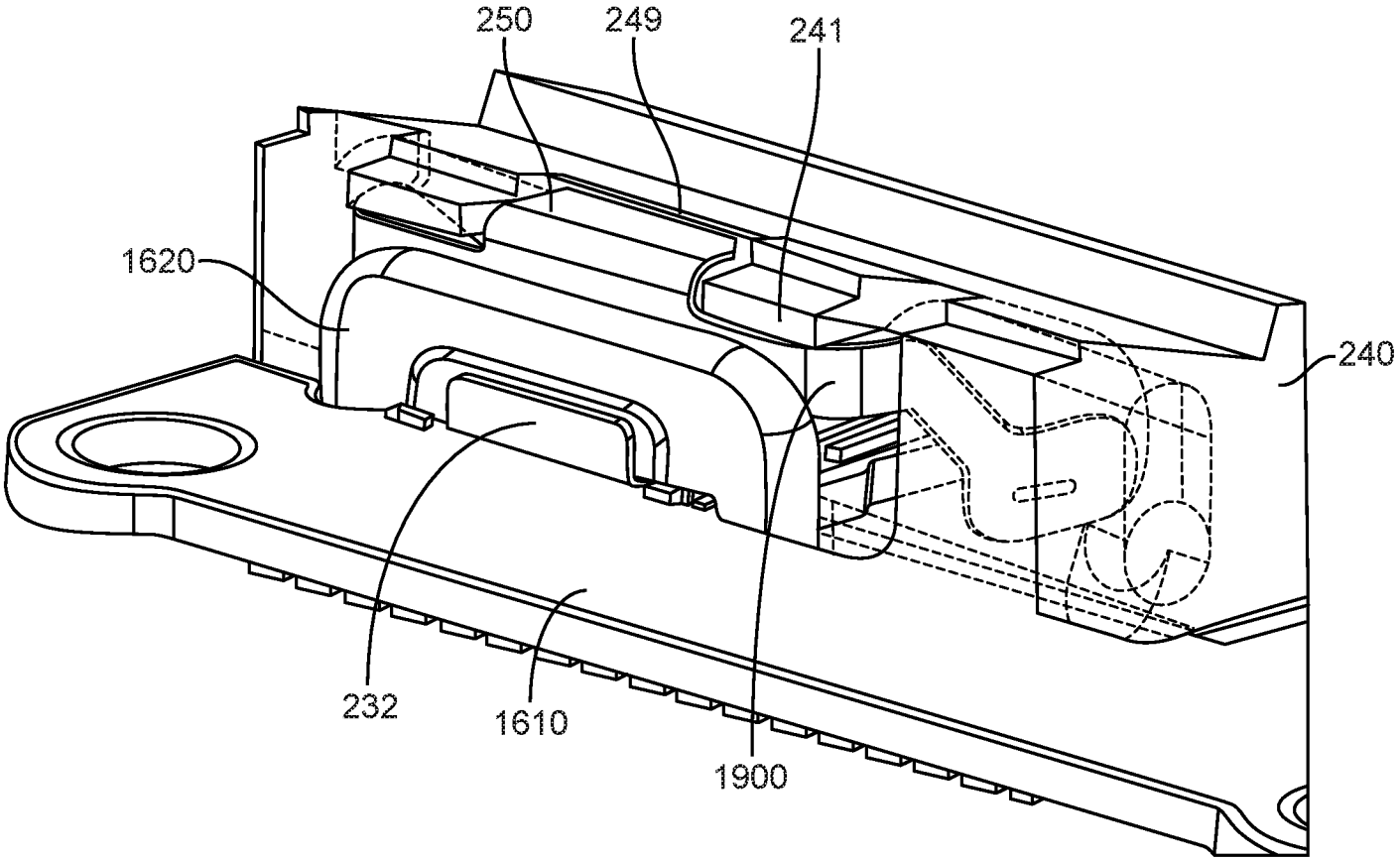
FIG. 23 illustrates an assembled connector receptacle according to an embodiment of the present invention.

FIG. 8 illustrates a transparent view of a portion of a connector receptacle according to an embodiment of the present invention. In this example, tongue 210 (shown in FIG. 3) may be located in passage 202 in device enclosure 240. Ground springs 600 may be located in recesses 800 in device enclosure 240. Openings 500 may connect recesses 800 to passage 202. Contacting portions 612 of ground springs 600 may be located in openings 500 in an inside surface of passage 202 in device enclosure 240. Contacting portions 612 of ground springs 600 may physically and electrically connect to a shield of a connector insert (not shown) when the connector insert is inserted into connector receptacle 200. Ground springs 600 may be grounded by making contact with sides and ends of recesses 800 when device enclosure 240 is conductive. Ground springs may also be grounded via conductive foam pieces and other conducive structures, examples of which are shown in FIGS. 18 and 23 below.

In this example, recesses 800 may be formed in an oblique direction such that recesses 800 are oblique to passage 202 and tongue 210 (shown in FIG. 3). The result is that openings 500 may be longest is a direction that is oblique to tongue 210. This also means that means ground springs 600 may be oblique with tongue 210.

Recesses 800 may be formed in various ways. An example is shown in the following figure.

Figure 9:
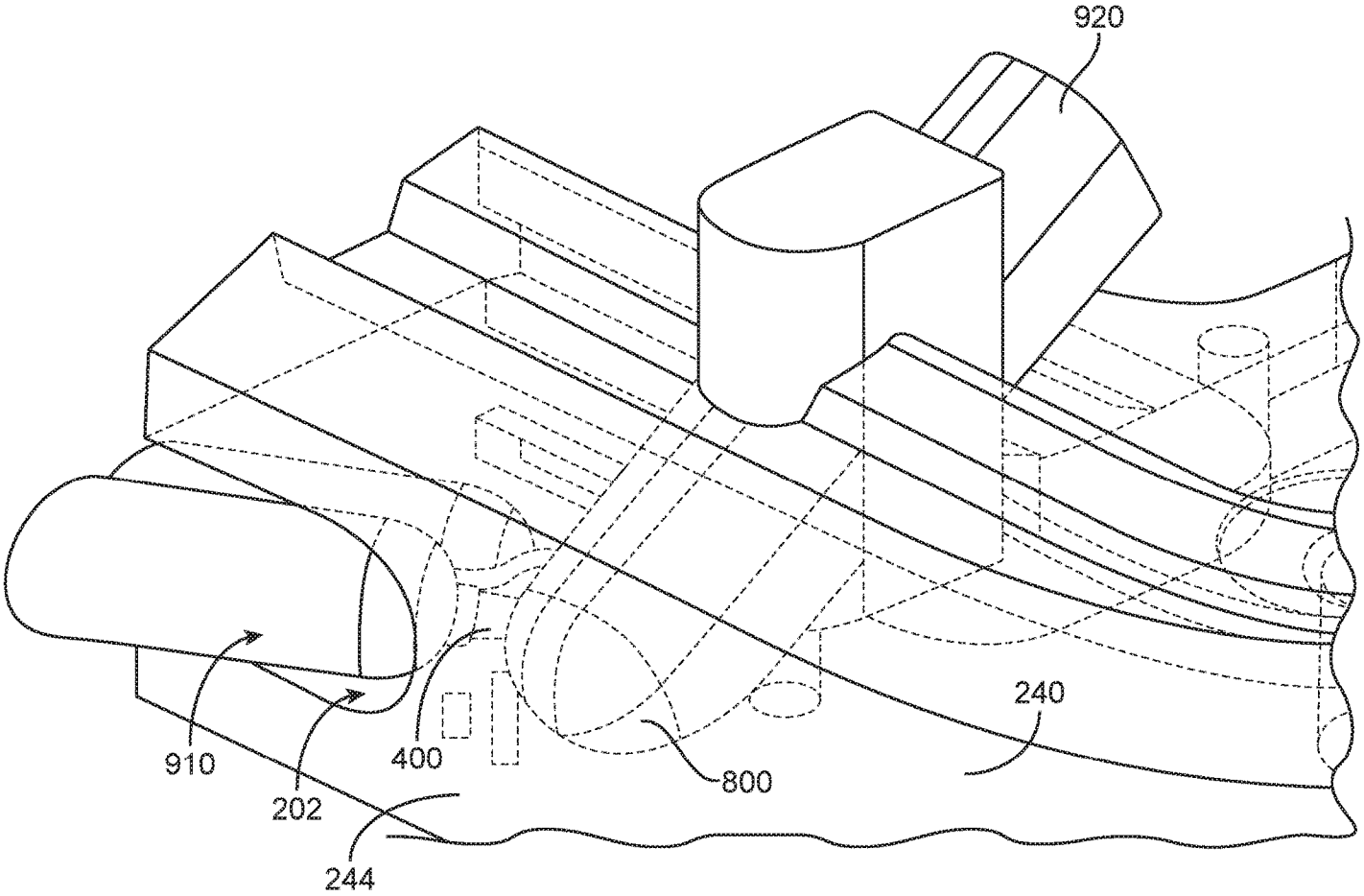
FIG. 9 illustrates a method of forming a recess for a ground spring in a device enclosure according to an embodiment of the present invention.

FIG. 9 illustrates a method of forming a recess for a ground spring in a device enclosure according to an embodiment of the present invention. A first cut (not shown) may be used to form recess 202 in device enclosure 240. A second cut 910 (which may be at a 30 degree angle relative to front surface 244 of device enclosure 240) may be used to form opening 500 (shown in FIG. 5). The second cut may be referred to as a break-through cut. A third cut 930, an angled step cut, may be made to form recess 800 in device enclosure 240. The third cut 930 may be a single cut or it may be a series of two, three, or more than three neighboring cuts. Third cut 930 may be oblique to the first cut that is used to form recess 202 in device enclosure 240.

Various ground springs may be used in these and other embodiments of the present invention. An example is shown in the following figure.

Figure 10:
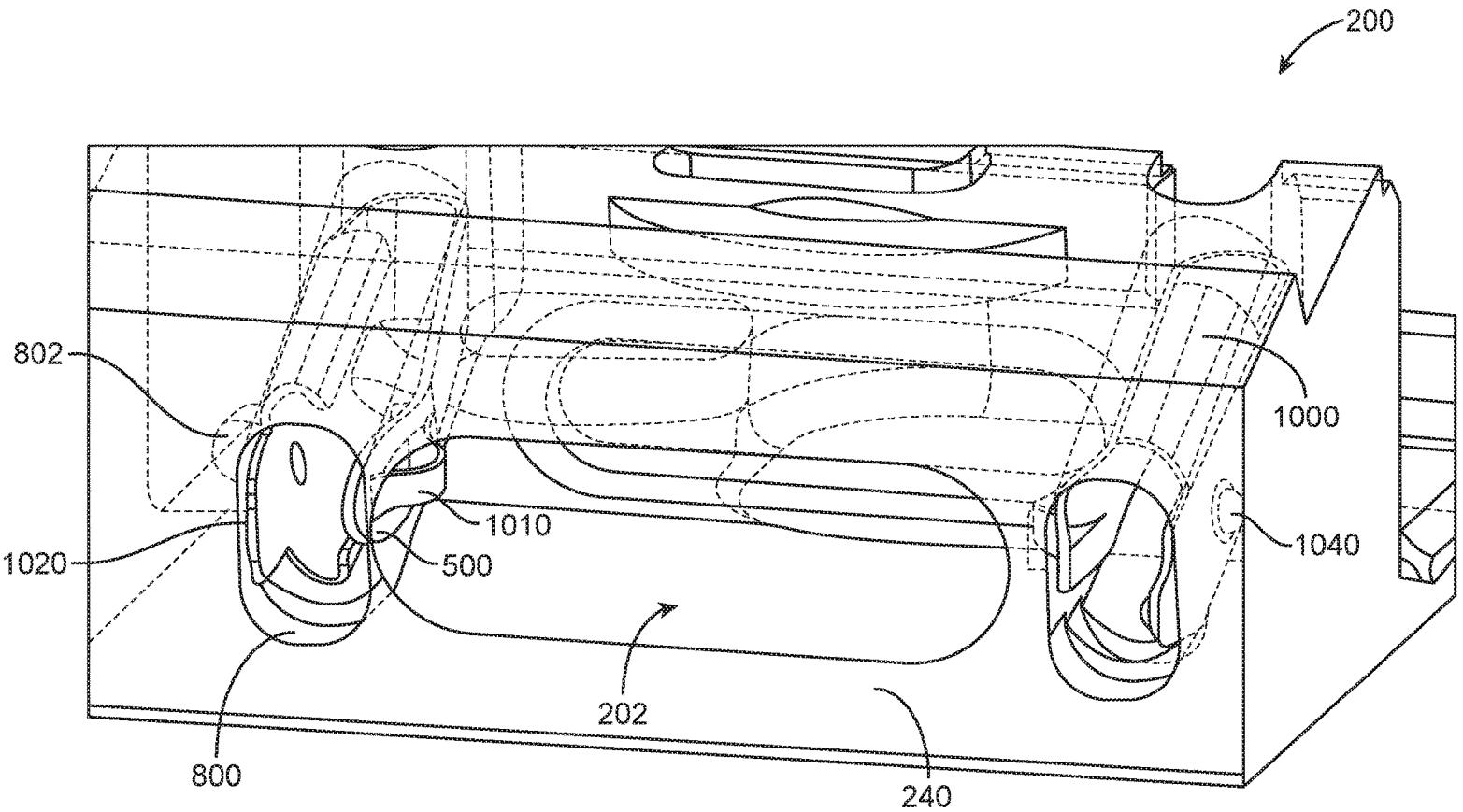
FIG. 10 illustrates a connector receptacle according to an embodiment of the present invention.

FIG. 10 illustrates a connector receptacle according to an embodiment of the present invention. In this example, connector receptacle 200 may include passage 202 in device enclosure 240 for tongue 210 (shown in FIG. 2). Recesses 800 may connect to passage 202 through openings 500. Ground springs 1000 may be inserted into recesses 800. Ground springs 1000 may have a substantially U-shaped body with a raised portion 1040 on one leg of the U-shape. Raised portion 1040 may fit in notch 802 in recess 800. Ground springs 1000 may further include lance 1010 on an opposing leg of the U-shape. Lance 1010 may be formed by stamping or other process in face 1020 of ground spring 1000. Lance 1010 may be located in opening 500 in passage 202 of device enclosure 240.

In this and other embodiments of the present invention, opening 500 may be formed in various ways. An example is shown in the following figure.

Figure 11:
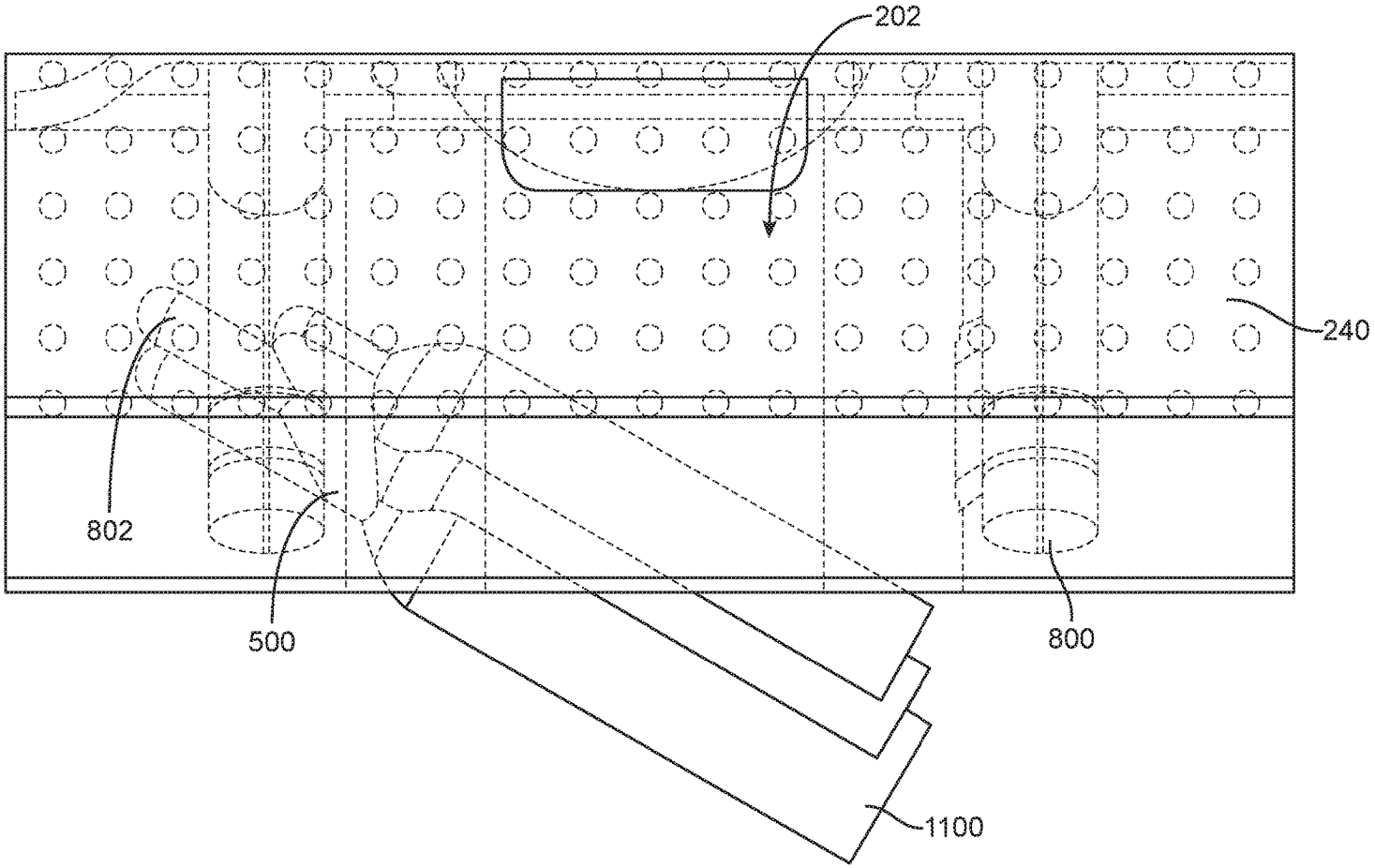
FIG. 11 illustrates a method of forming an opening in a recess in a device enclosure according to an embodiment of the present invention.

FIG. 11 illustrates a method of forming an opening in a recess in a device enclosure according to an embodiment of the present invention. In this example, recesses 800 and passage 202 may be formed in device enclosure 240. Cut 1100, which may be a series of step cuts, may be used to form opening 500. One or more of these cuts may be of sufficient length that they extend through recess 800 to form notch 802.

In the above examples, opening 400 (shown in FIG. 4) may be substantially vertical in passage 202, while opening 500 (shown in FIG. 5) may be formed at an oblique angle in passage 202. In these and other embodiments the present invention, opening 400 or opening 500 may be substantially horizontal. In these and other embodiments of the present invention, other ground springs may be used along with horizontal openings. Examples are shown in the following figures.

Figure 12:
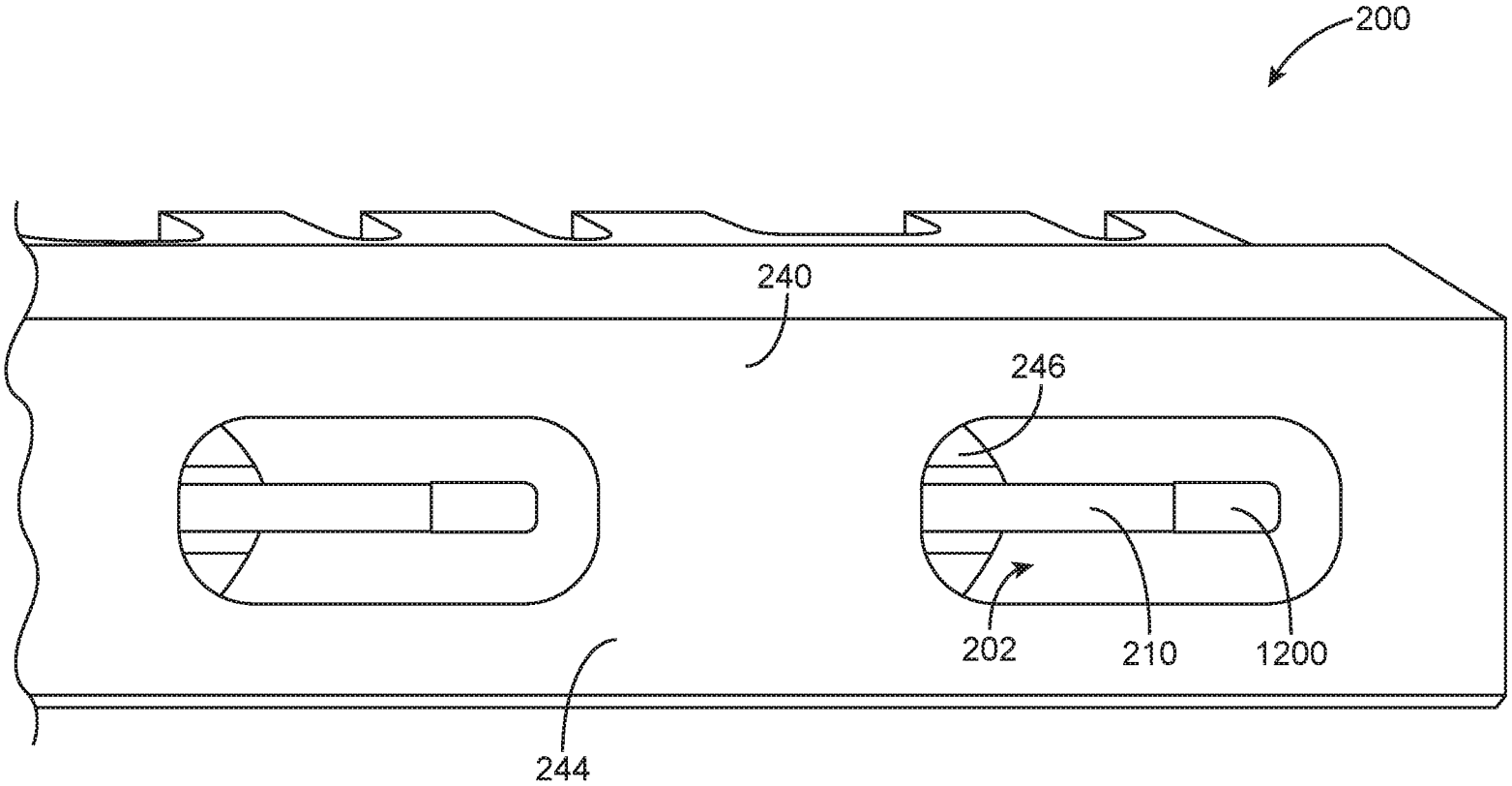
FIG. 12 illustrates a front oblique view of a pair of connector receptacles according to an embodiment of the present invention.

FIG. 12 illustrates a front oblique view of a pair of connector receptacles according to an embodiment of the present invention. In this example, each connector receptacle 200 may include tongue 210 located in passage 202 in device enclosure 240. Passage 202 may extend from rear surface 246 to front surface 244 of device enclosure 240. Ground springs 1200 may be located in openings in sides of passage 202. As before, ground springs 1200 may be located on either or both lateral sides of passage 202, on a top side, bottom side, or both top and bottom sides of passage 202, or any combination thereof.

Ground springs 1200 may be formed in various ways. Examples of ground springs that may be used as ground springs 1200 are shown in the following figures.

Figure 13:
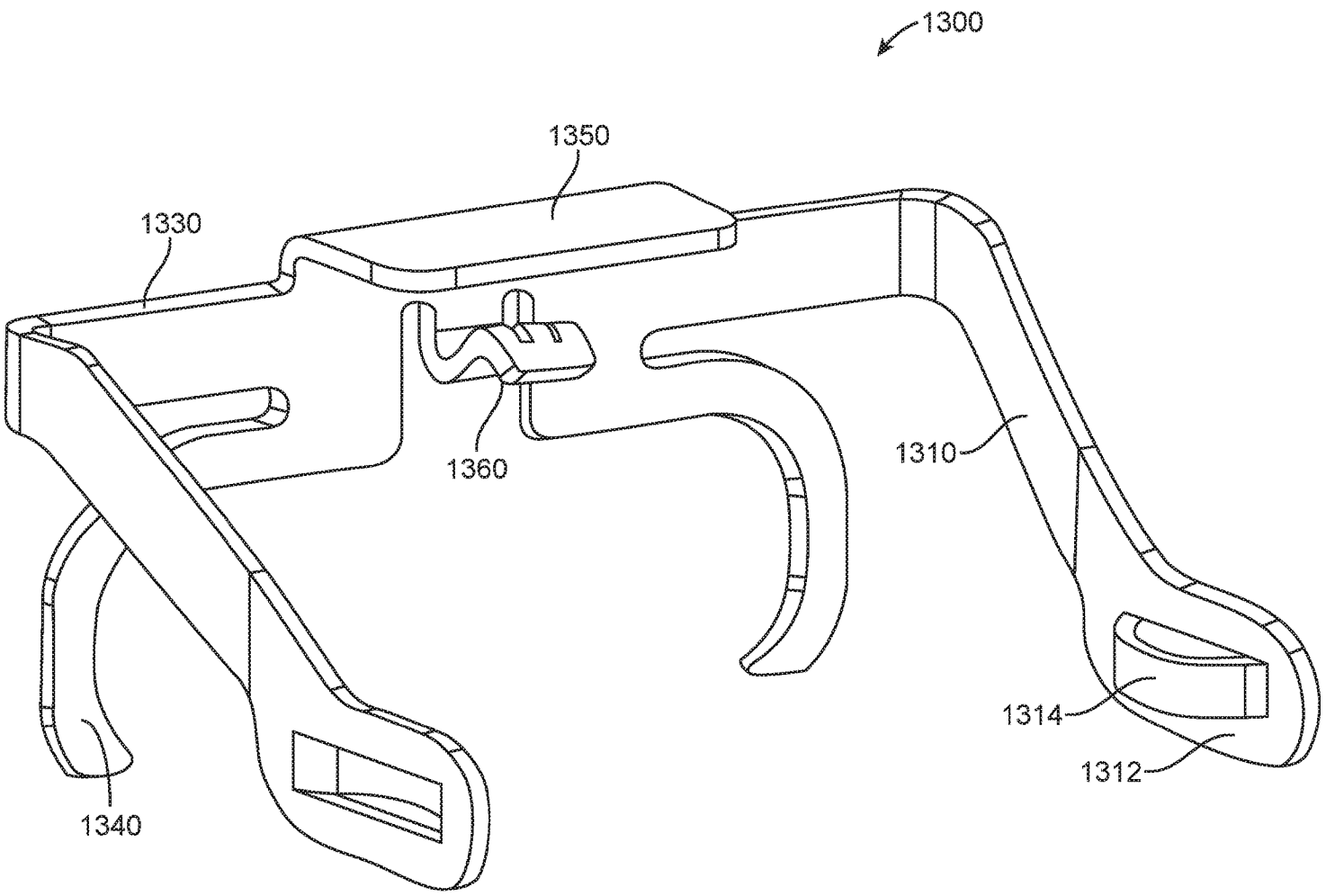
FIG. 13 illustrates another ground spring according to an embodiment of the present invention.

FIG. 13 illustrates another ground spring according to an embodiment of the present invention. Ground spring 1300 may be used as ground spring 1200 or as other ground springs in other embodiments of the present invention. Ground spring 1300 may include arms 1310 connected together by joining portion 1330. Arms 1310 may terminate in contacting portions formed by face 1312 and lance 1314. Tab 1350 may be folded orthogonally relative to joining portion 1330. Ground spring 1300 may further include stabilizing features, such as tab 1360 and extensions 1340.

In various embodiments of the present invention, arms 1310 may be located in recesses 800 (shown in FIG. 8). Lances 1314 may be located in openings (not shown) in a passage of a connector receptacle. Tab 1350 may be located in a notch in device enclosure 240 (not shown). Tab 1360 may be inserted into a slot (not shown) in the device enclosure 240 for additional stability.

Figure 14:
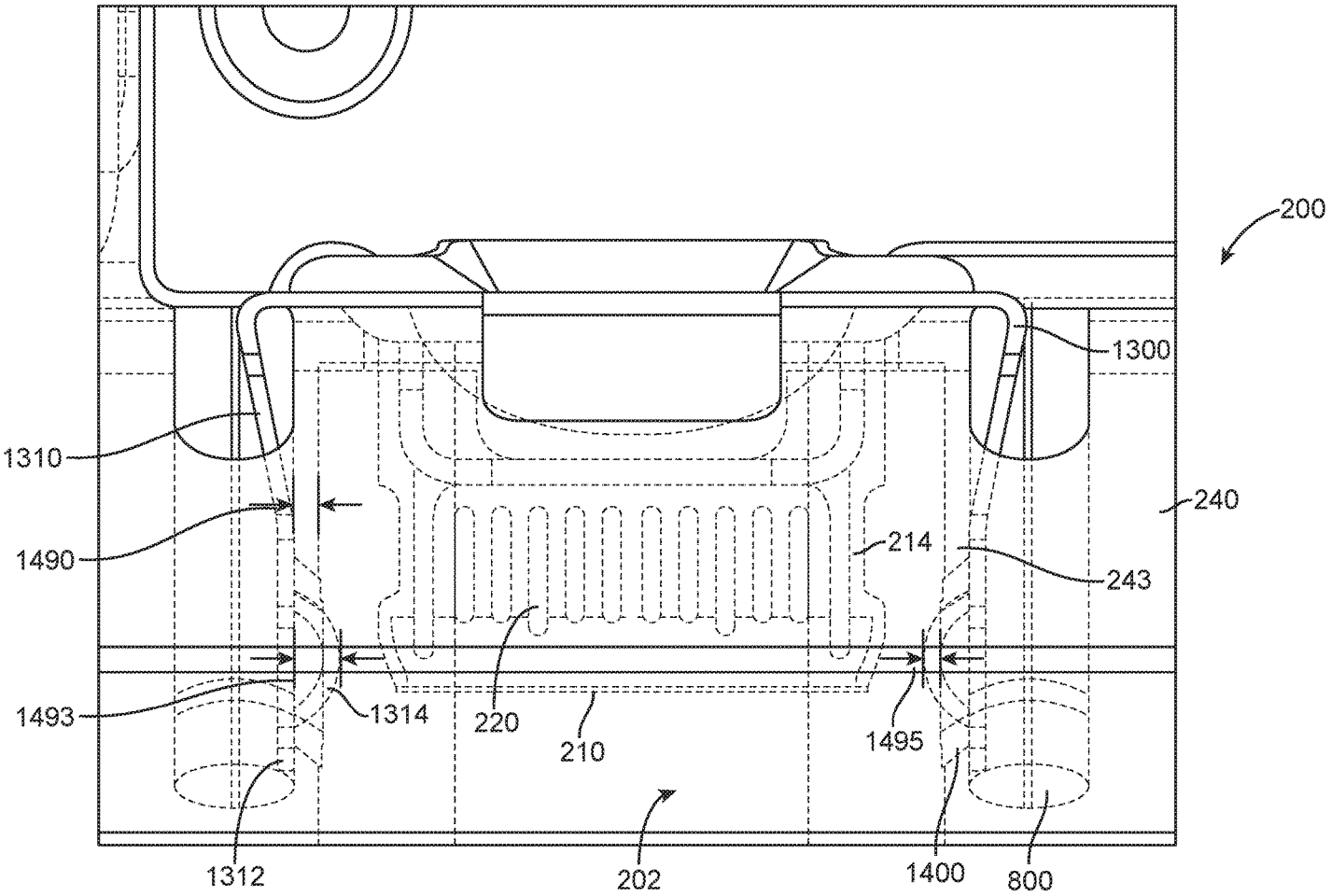
FIG. 14 is a transparent view of a connector receptacle according to an embodiment of the present invention.

FIG. 14 is a transparent view of a connector receptacle according to an embodiment of the present invention. In this example, connector receptacle 200 may include tongue 210 located in passage 202 in device enclosure 240. Arms 1310 of ground springs 1300 may be located in recesses 800. Openings 1400 may connect passage 202 to recesses 800. Openings 1400 may be formed in a manner that is the same or similar to openings 400 or 500 as shown above. Arms 1310 of ground springs 1300 may terminate in contacting portions having faces 1312 and lances 1314. Lances 1314 may be available at openings 1400. Tongue 210 may support power and signal contacts 220. Notches 214 may be located in sides of tongue 210.

Again, when a connector insert (not shown) is inserted into connector receptacle 200, side ground springs in the connector insert may engage notches 214 on tongue 210. This may provide a tactile response indicating that the connector insert has been mated with connector receptacle 200. Accordingly, to avoid confusion, it may be desirable to control and amount of tactile response provided when lance 1314 of ground spring 1300 encounters a shield of a connector insert.

This amount of tactile response may be controlled by controlling and amount of lance 1314 that extends into passage 202 in device enclosure 240. Specifically, walls 243 between recesses 800 and passage 202 may have a thickness 1490. Lance 1314 may have a depth 1493. Wall thickness 1490 and depth 1493 of lance 1314 may be controlled in order to accurately control a depth 1495 that lance 1314 extends into passage 202. In this way, a force provided by ground springs 1300 when a connector insert is inserted into connector receptacle 200 may be limited such that a confusing tactile response is not perceived before retention springs in the connector insert (not shown) engage notches 214 on tongue 210.

Figure 15:
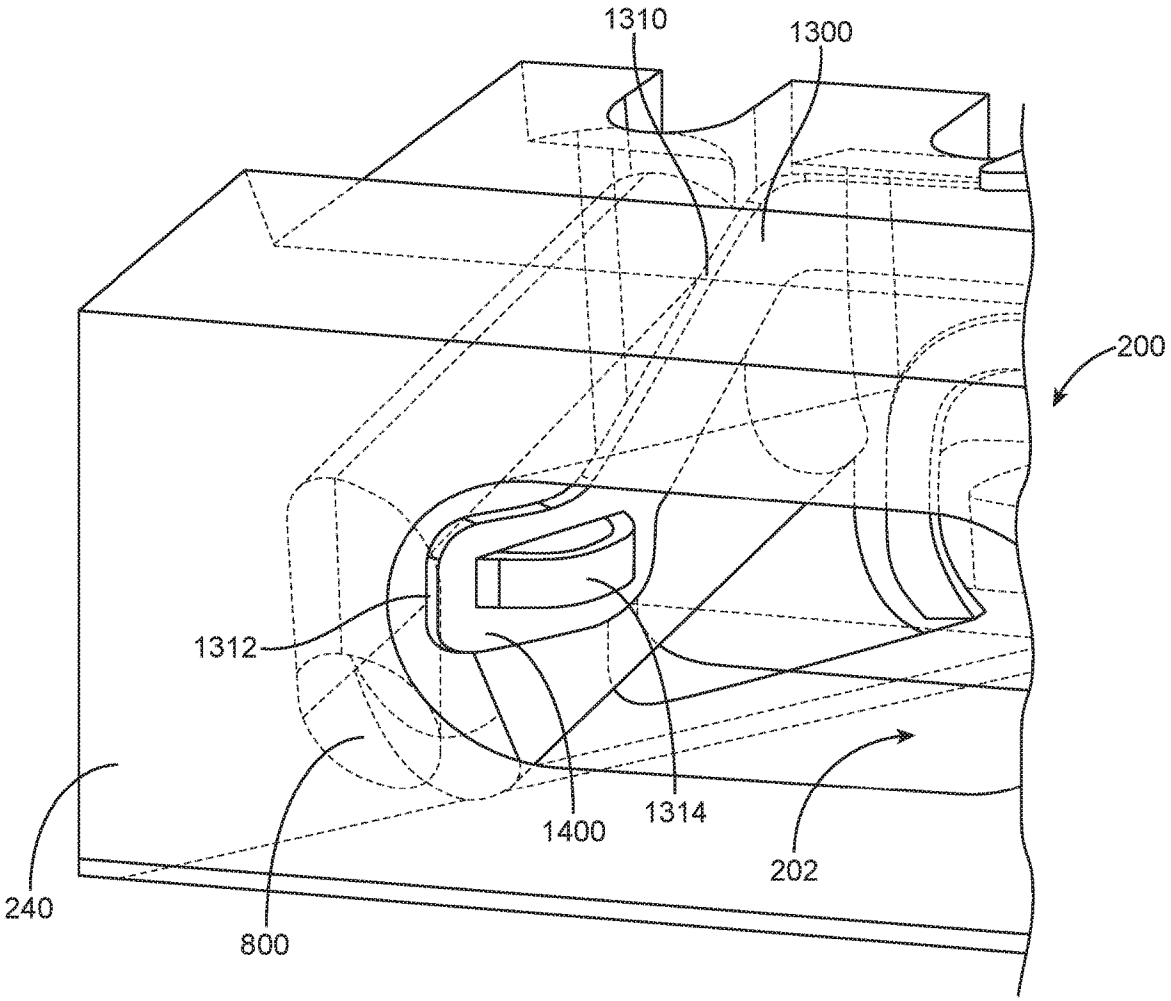
FIG. 15 illustrates an oblique side view of a portion of a connector receptacle according to an embodiment of the present invention.

FIG. 15 illustrates an oblique side view of a portion of a connector receptacle according to an embodiment of the present invention. As before, arms 1310 of ground springs 1300 may be located in recesses 800 in device enclosure 240. Lance 1314 may be located in opening 1400 in a side of passage 202. Lance 1314 may extend from face 1312.

Lance 1314 may be a robust and reliable feature that may withstand the wear of many insertions of a connector insert. Face 1312 may provide a cosmetic benefit in that it may hide or make gaps between lance 1314 and opening 1400 less apparent.

Figure 16:
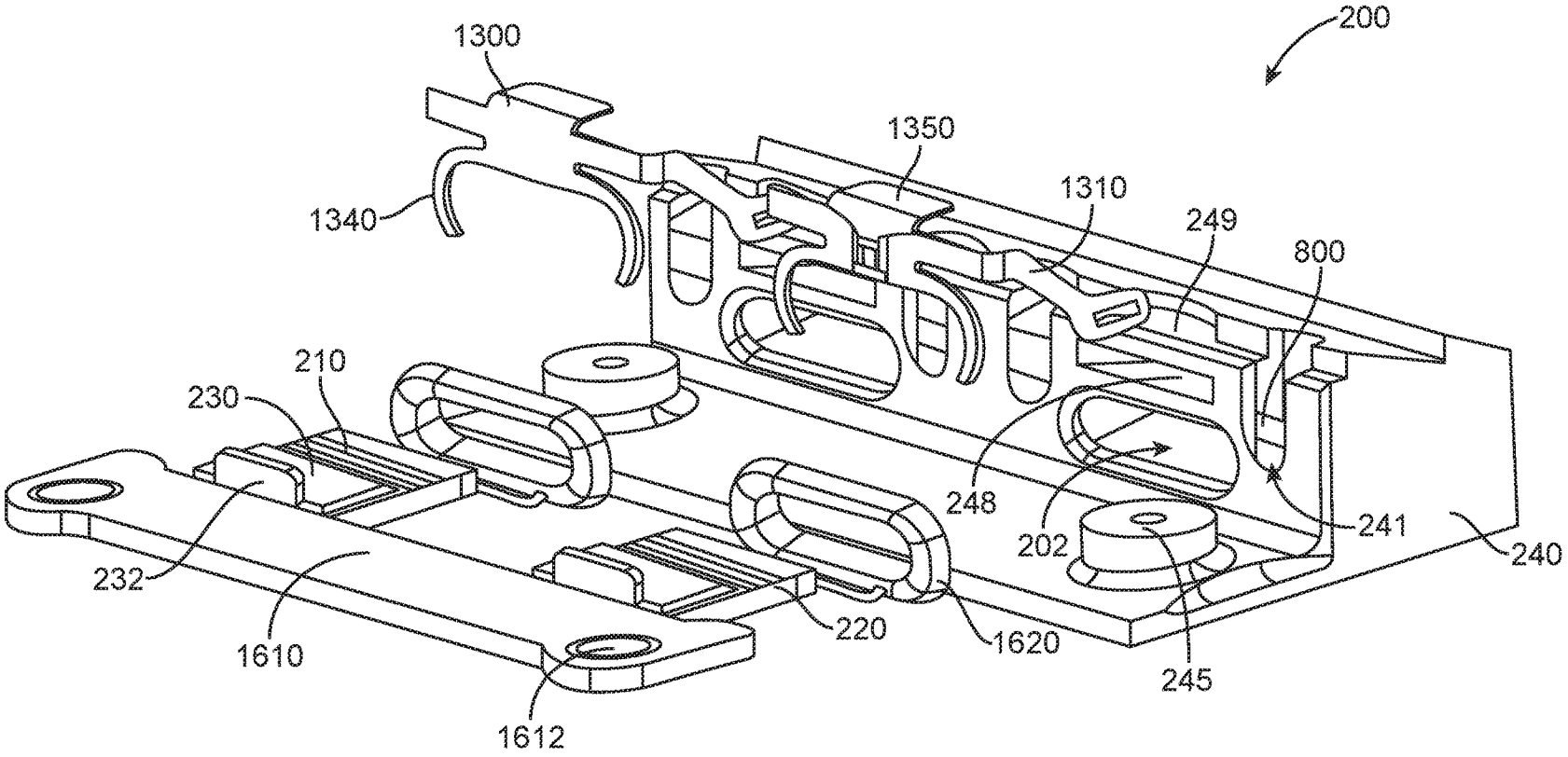
FIG. 16 illustrates an assembly of a pair of connector receptacles according to an embodiment of the present invention.

FIG. 16 illustrates an assembly of a pair of connector receptacles according to an embodiment of the present invention. In this example, tongues 210 may be joined by, or formed as part of, board 1610. Tongue 210 may support signal and power contacts 220 and ground contacts 230. Ground contacts 230 may include angled tabs 232. Arms 1310 of ground spring 1300 may be inserted into recesses 800 in device enclosure 240. Tabs 1350 of ground springs 1300 may be located in notches 249. O-rings 1620 may be placed around tongues 210 and against tabs 232. O-rings 1620 may be formed of conductive foam or other materials. Tongues 210 may be inserted into passages 202 in device enclosure 240 such that O-rings 1620 may be between tabs 232 of ground contacts 230 and extensions 1340 of ground springs 1300. Extensions 1340 may be located against a rear surface 241 of device enclosure 240. Fasteners (not shown) may be inserted through openings 1612 of board 1610 into openings 245 to secure board 1610 to device enclosure 240.

Figure 17:
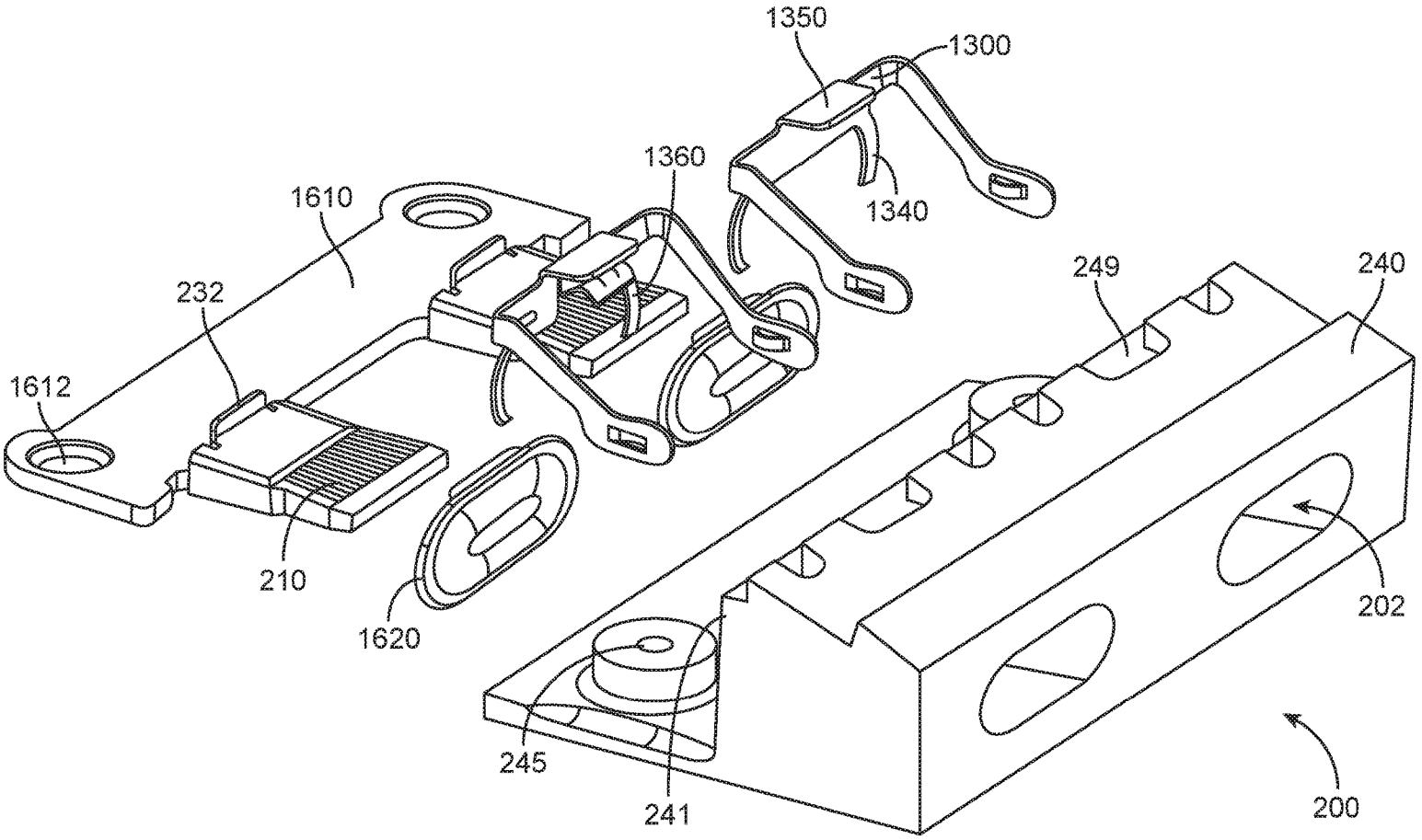
FIG. 17 illustrates an assembly of a pair of connector receptacles according to an embodiment of the present invention.

FIG. 17 illustrates an assembly of a pair of connector receptacles according to an embodiment of the present invention. In this example, tongues 210 may be joined by, or formed as part of, board 1610. Tongue 210 may support signal and power contacts 220 and ground contacts 230. Ground contacts 230 may include angled tabs 232. Tabs 1350 of ground springs 1300 may be located in notches 249. O-rings 1620 may be placed around tongues 210 and against tabs 232. Tongues 210 may be inserted into passages 202 in device enclosure 240 such that O-rings 1620 may be between tabs 232 of ground contacts 230 and extensions 1340 of ground springs 1300. Extensions 1340 may be located against a rear surface 241 of device enclosure 240. Fasteners (not shown) may be inserted through openings 1612 of board 1610 into openings 245 to secure board 1610 to device enclosure 240.

FIG. 18 illustrates an assembled pair of connector receptacles according to an embodiment of the present invention. In this example, ground springs 1300 may be placed against an inside surface 241 of device enclosure 240. O-rings 1620 may be located between tabs 232 and ground springs 1300. Board 1610 may be attached to device enclosure 240 using one or more fasteners (not shown) in openings 1612.

Ground springs 1300 may be grounded via conductive foam O-rings 1620 and ground tabs 232. Also, when device enclosure 240 is conductive, ground springs 1300 may be grounded via device enclosure 240. Similar grounding techniques may be used for ground springs 600 and the other ground springs shown herein.

In the above examples, manufacturing tolerances may result in some connector receptacles 200 having lances 1314 on arms 1310 of ground springs 1300 offset enough such that they may contact an edge of opening 1400 in passage 202 in device enclosure 240. Binding between lance 1314 and edges of openings 1400 may be avoided or limited by making arms 1310 of ground springs 1300 flexible. The chances of binding may be further reduced by removing stabilizing features such as tab 1350, extensions 1340, or both on a ground spring. An example is shown in the following figure.

Figure 19:
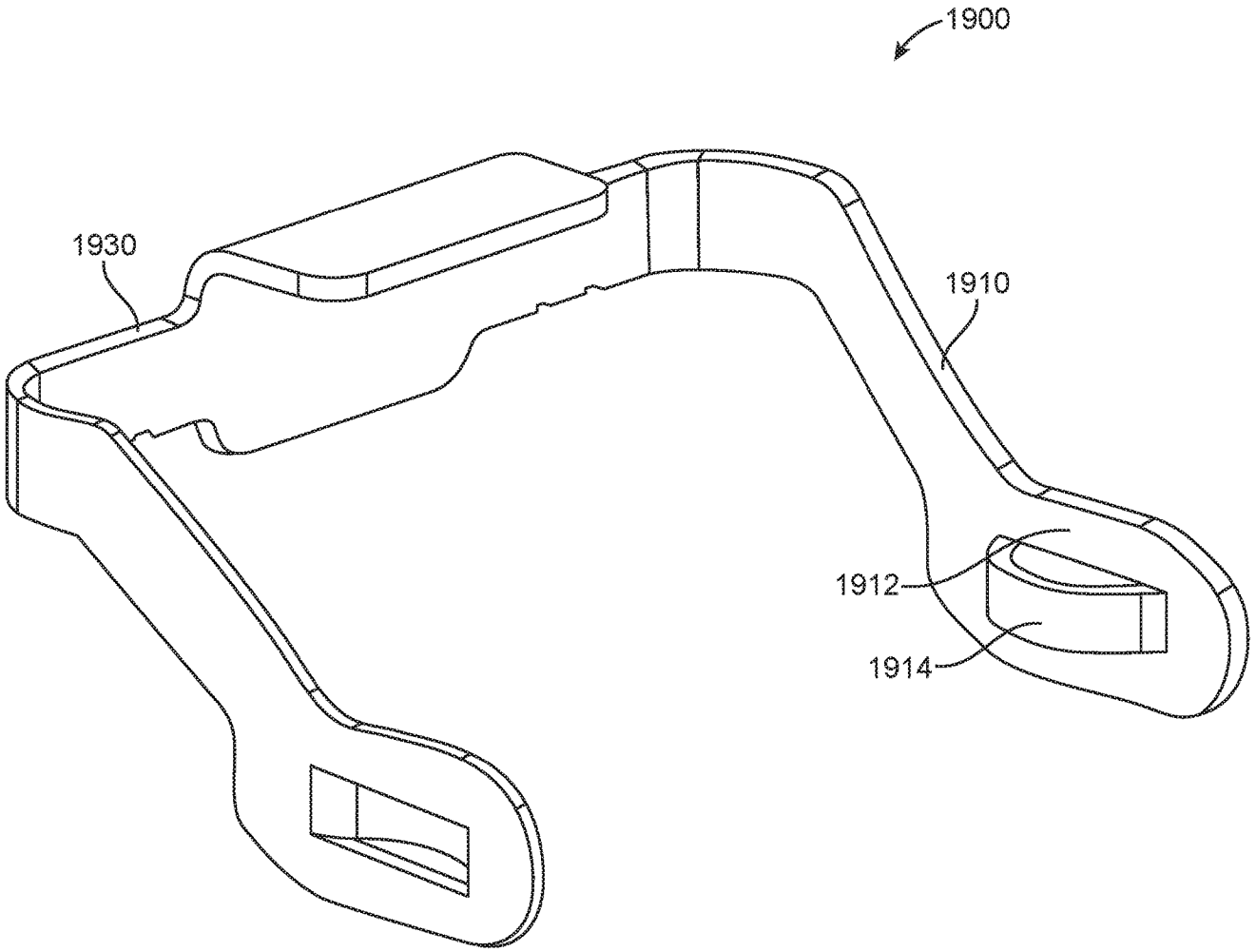
FIG. 19 illustrates another ground spring according to an embodiment of the present invention.

FIG. 19 illustrates another ground spring according to an embodiment of the present invention. Ground spring 1900 may be used as ground spring 1200 or as other ground springs in other embodiments of the present invention.

Ground spring 1900 may include arms 1910 connected together by joining portion 1930. Arms 1910 may terminate in contacting portions formed by face 1912 and lance 1914. Tab 1950 may be folded orthogonally relative to joining portion 1930. In this example, ground spring 1900 does not include stabilizing features, such as tab 1360 and extensions 1340 (shown in FIG. 13). Ground spring 1900 may be the same or substantially similar to ground springs 1300, with the absence of the stabilizing features tab 1360 and extensions 1340 and may operate in the same or similar manner in connector receptacle 200.

In various embodiments of the present invention, arms 1910 may be located in recesses 800 (shown in FIG. 8). Lances 1914 may be located in openings (not shown) in a passage of a connector receptacle. Tabs 1950 may be located in a notch in device enclosure 240 (not shown).

Figure 20:
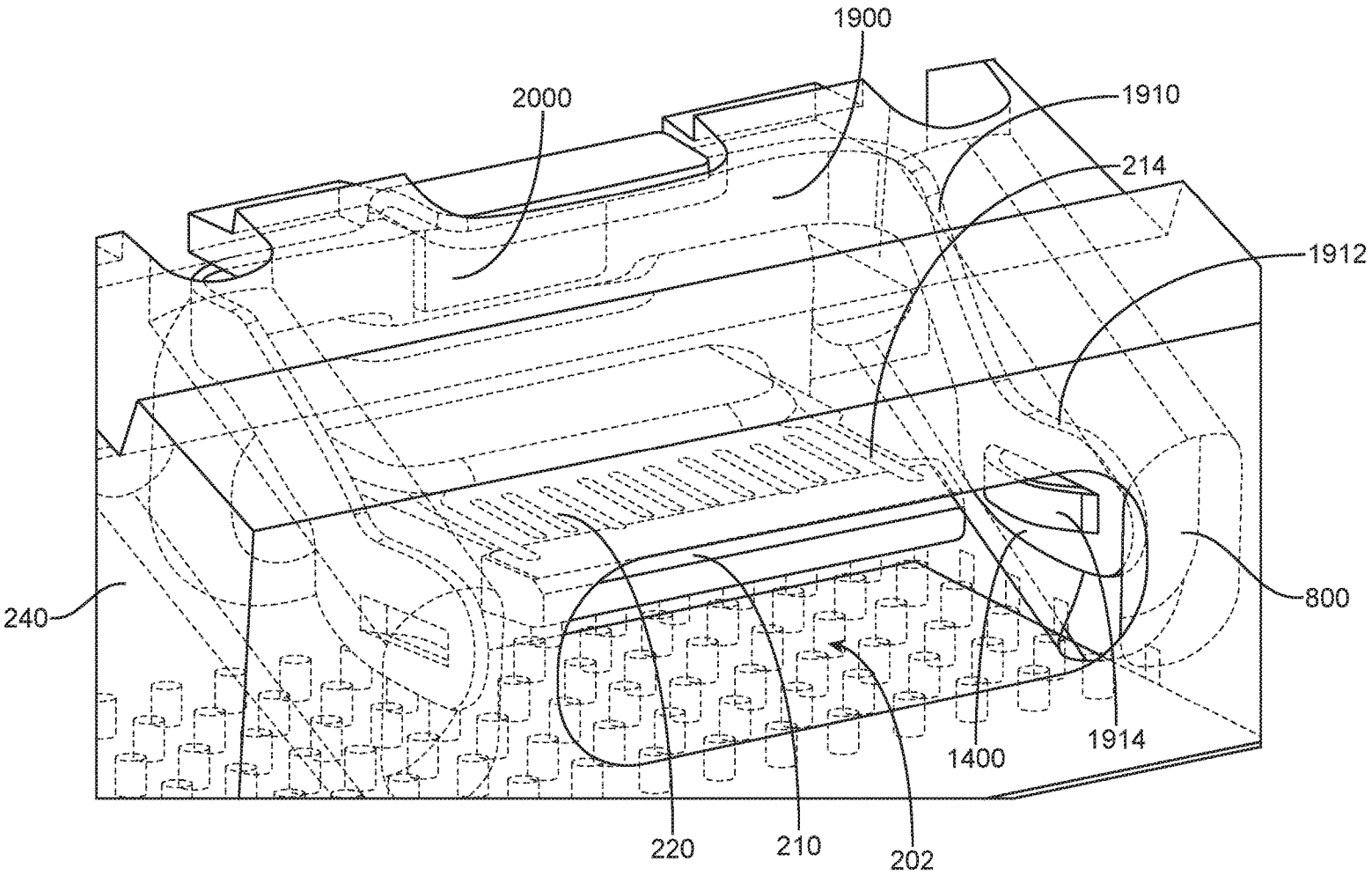
FIG. 20 is a transparent view of a connector receptacle according to an embodiment of the present invention.

FIG. 20 is a transparent view of a connector receptacle according to an embodiment of the present invention. In this example, connector receptacle 200 may include tongue 210 located in passage 202 in device enclosure 240. Arms 1910 of ground springs 1900 may be located in recesses 800. Openings 1400 may connect passage 202 to recesses 800. Openings 1400 may be formed in a manner that is the same or similar to openings 400 or 500 as shown above. Arms 1910 of ground springs 1900 and may terminate in contacting portions having face 1912 and lances 1914. Lances 1914 may be available at openings 1400. Tongue 210 may support power and signal contacts 220. Notches 214 may be located in sides of tongue 210. Conductive foam piece 2000 may be located between ground spring 1900 and device enclosure 240.

As before, an amount of tactile response may be controlled by controlling and amount of lance 1914 that extends into passage 202 in device enclosure 240. Specifically, walls (not shown) between recesses 800 and passage 202 may have a thickness that, along with the depth (not shown) of lance 1914, may be controlled in order to accurately control a depth (not shown) that lance 1914 extends into passage 202. In this way, a force provided by ground spring 1900 when a connector insert is inserted into connector receptacle 200 may be limited such that a confusing tactile response is not perceived before retention springs in the connector insert (not shown) engage notches 214 on tongue 210. Also, lance 1914 may be a robust and reliable feature that may withstand the wear of many insertions of a connector insert. Face 1912 may provide a cosmetic benefit in that it may hide or make gaps between lance 1914 and opening 1400 less apparent.

Figure 21:
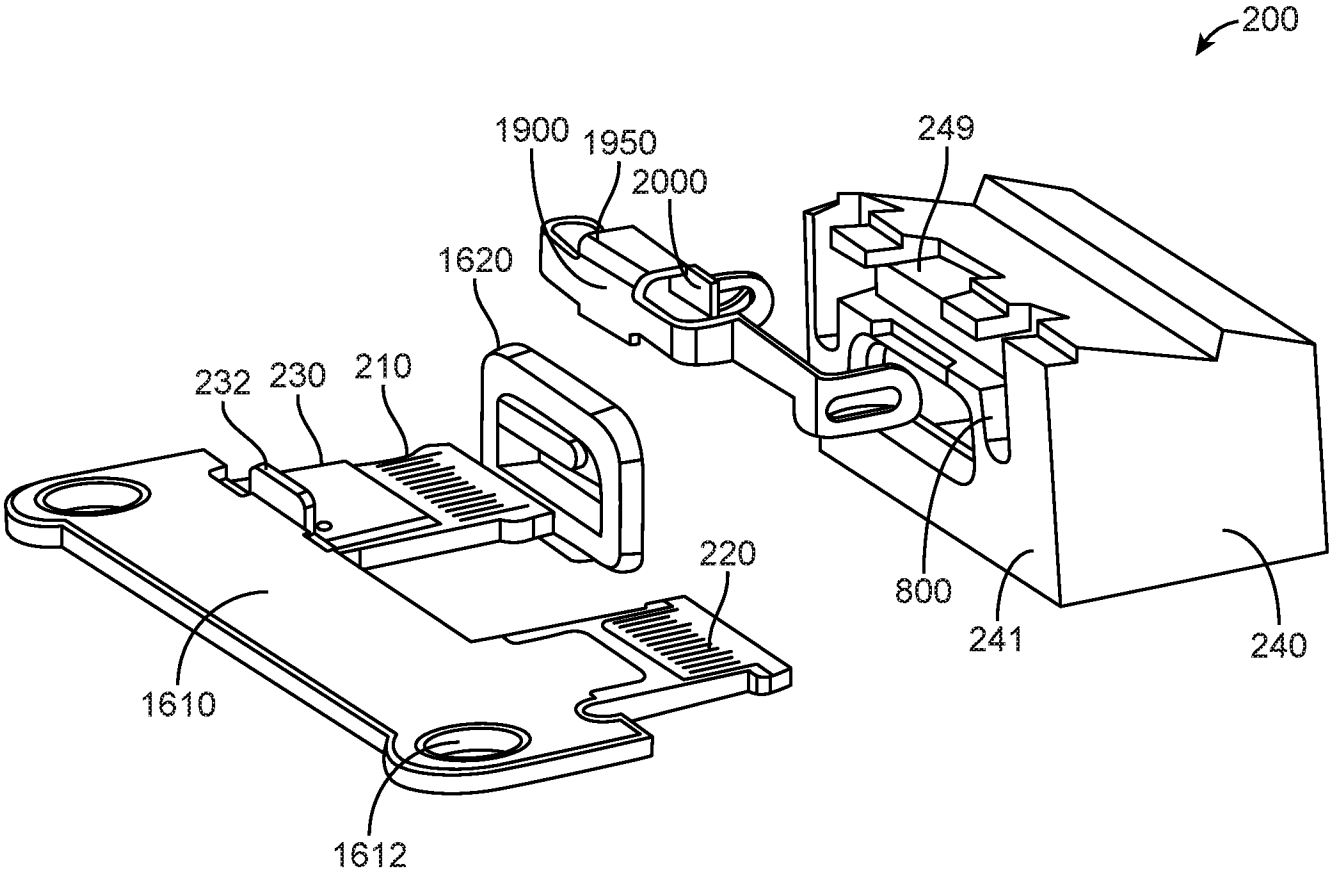
FIG. 21 illustrates an assembly of a connector receptacle according to an embodiment of the present invention.

FIG. 21 illustrates an assembly of a connector receptacle according to an embodiment of the present invention. In this example, tongues 210 may be joined by, or formed as part of board 1610. Tongues 210 may support signal and power contacts 220 and ground contacts 230. Ground contacts 230 may include angled tabs 232. Arms 1910 of ground spring 1900 may be inserted into recesses 800 in device enclosure 240. Tabs 1950 may be located in notches 249. O-rings 1620 may be placed around tongue 210 and against tabs 232. Tongues 210 may be inserted into passages 202 in device enclosure 240 such that O-rings 1620 are between tabs 232 of ground contacts 230 and joining portion 1930 of ground springs 1900. Fasteners (not shown) may be inserted into opening 1612 to secure board 1610 to device enclosure 240. Optional conductive foam piece 2000 may be placed between ground springs 1900 and device enclosure 240.

Figure 22:
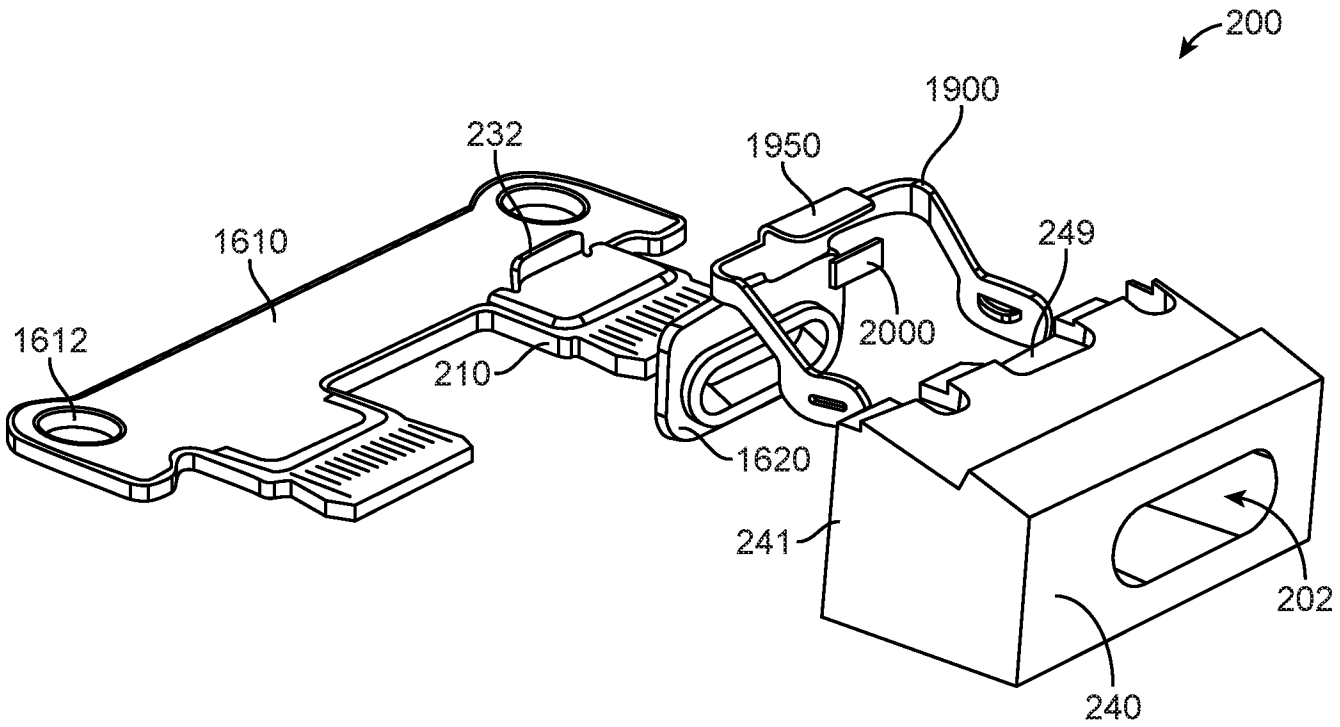
FIG. 22 illustrates an assembly of a connector receptacle according to an embodiment of the present invention.

FIG. 22 illustrates an assembly of a connector receptacle according to an embodiment of the present invention. In this example, tongues 210 may be joined by, or formed as part of board 1610. Tongues 210 may support signal and power contacts 220 and ground contacts 230. Ground contacts 230 may include angled tabs 232. Arms 1910 of ground spring 1900 may be inserted into recesses 800 in device enclosure 240. Tabs 1950 may be located in notches 249. O-rings 1620 may be placed around tongue 210 and against tabs 232. Tongues 210 may be inserted into passages 202 in device enclosure 240 such that O-rings 1620 are between tabs 232 of ground contacts 230 and joining portion 1930 of ground springs 1900. Fasteners (not shown) may be inserted into opening 1612 to secure board 1610 to device enclosure 240. Optional conductive foam piece 2000 may be placed between ground springs 1900 and device enclosure 240.

FIG. 23 illustrates an assembled connector receptacle according to an embodiment of the present invention. In this example, ground springs 1900 may be placed against an inside surface 241 of device enclosure 240. O-ring 1620 may be located between tabs 232 and ground springs 1300. Board 1610 may be attached to device enclosure 240 using one or more fasteners (not shown) in openings 1612.

Ground springs 1900 may be grounded via conductive foam O-rings 1620 and ground tabs 232. Also, when device enclosure 240 is conductive, ground springs 1300 may be grounded via device enclosure 240.

Figure 24:
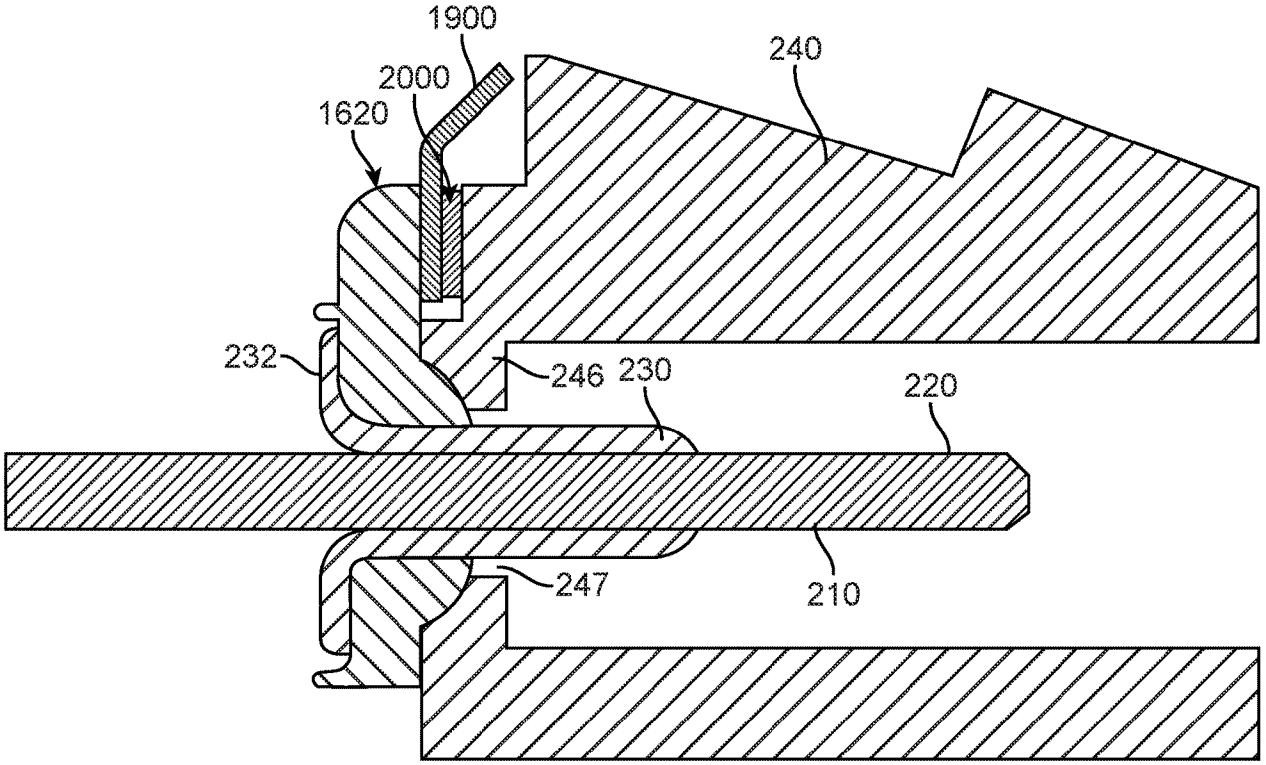
FIG. 24 is a cutaway side view of a connector receptacle according to an embodiment of the present invention.

FIG. 24 is a cutaway side view of a connector receptacle according to an embodiment of the present invention. In this example, O-ring 1620 may be between ground tab 232 and ground spring 1900. Conductive foam piece 2000 may be between ground spring 1900 and device enclosure 240. Tongue 210 may support contacts 220 and may be located in opening 247 of rear surface 246 of device enclosure 240.

Figure 25:
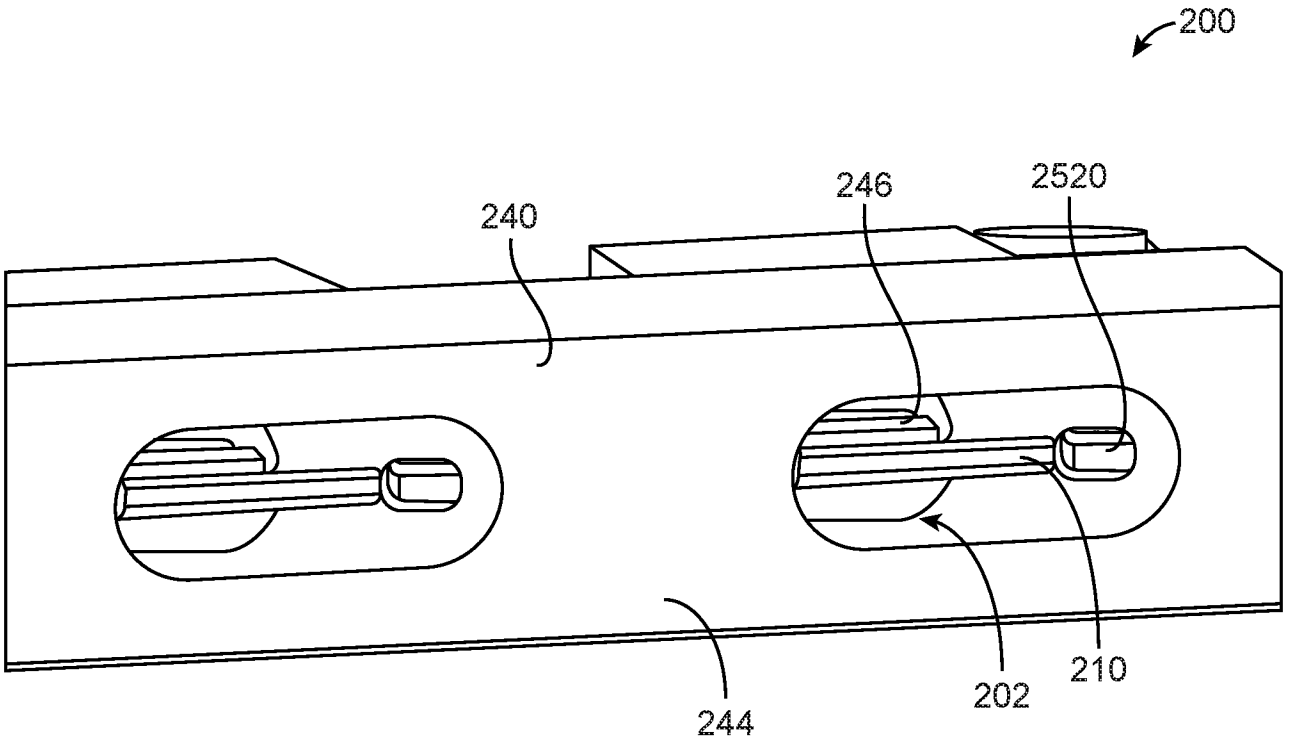
FIG. 25 illustrates a front oblique view of a pair of connector receptacles according to an embodiment of the present invention.

FIG. 25 illustrates a front oblique view of a pair of connector receptacles according to an embodiment of the present invention. In this example, each connector receptacle 200 may include tongue 210 located in passage 202 in device enclosure 240. Passage 202 may extend from rear surface 246 to front surface 244 of device enclosure 240. Ground springs 2500 may be located in openings in sides of passage 202. As before, ground springs 2500 may be located on either or both lateral sides of passage 202, on a top side, bottom side, or both top and bottom sides of passage 202, or any combination thereof.

Figure 26:
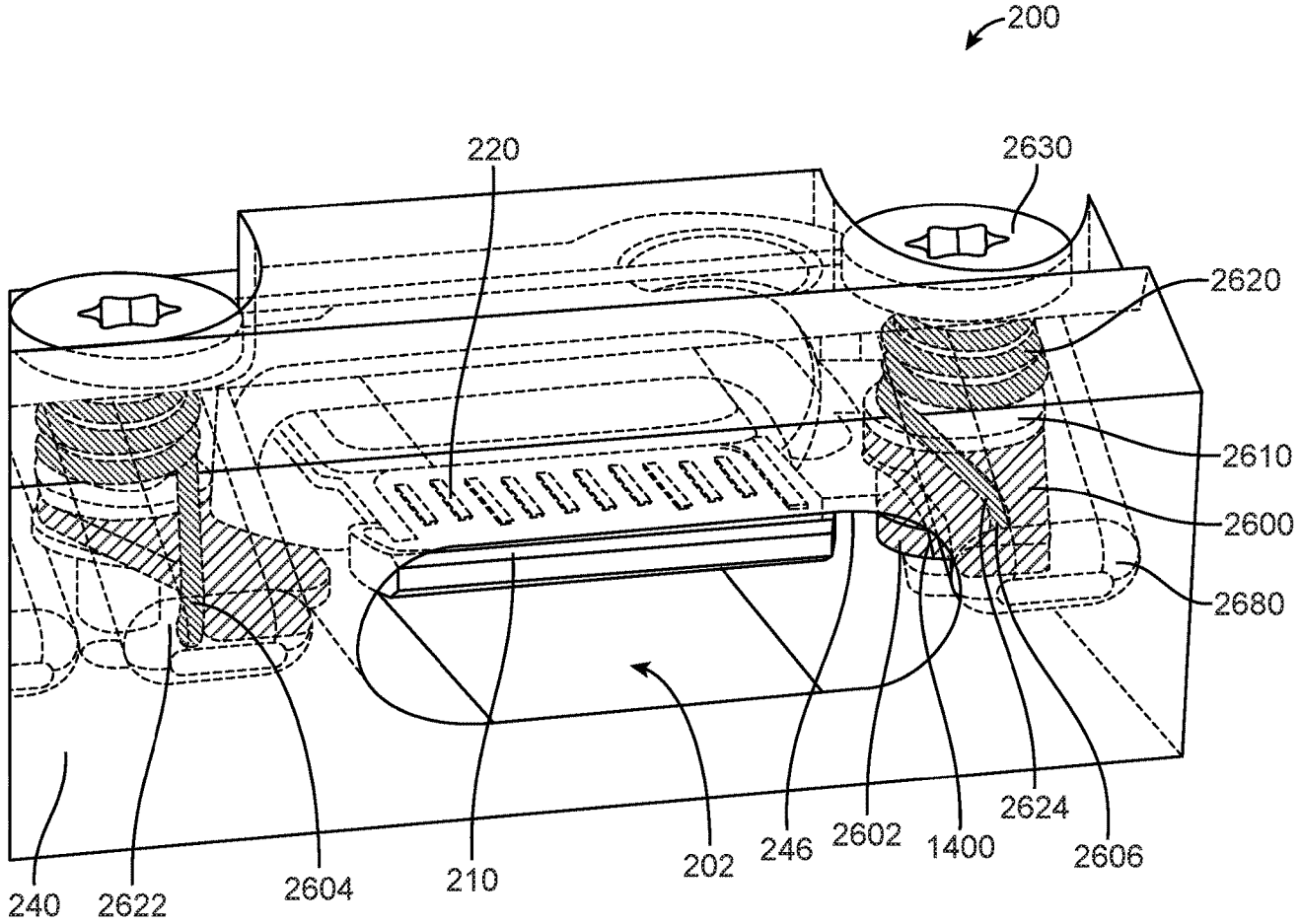
FIG. 26 is a transparent view of a connector receptacle according to an embodiment of the present invention.

FIG. 26 is a transparent view of a connector receptacle according to an embodiment of the present invention. Receptacle 200 may include tongue 210 located in passage 202. Tongue 210 may support a number of signal and power contacts 220. In this example, ground springs 2500 may be provided by spring-biased cams 2600. Cams 2600 may include contacting portion 2602, which may be located in opening 1400 in passage 202 of device enclosure 240. Openings 1400 may connect passage 202 to recesses 2680. Cam 2600 may be driven by spring 2620. One or more washers 2610 may isolate spring 2620. Fastener 2630 may hold spring 2620, washers 2610, and cam 2600 in place in receptacle 2680 in device enclosure 240.

In various embodiments of the present invention, spring 2620 may drive cam 2600 in various ways. For example, portion 2624 of spring 2620 may fit in opening 2606 in cam 2600. In other embodiments of the present invention, portion 2622 of spring 2620 may push against a back surface 2604 of cam 2600.

Figure 27:
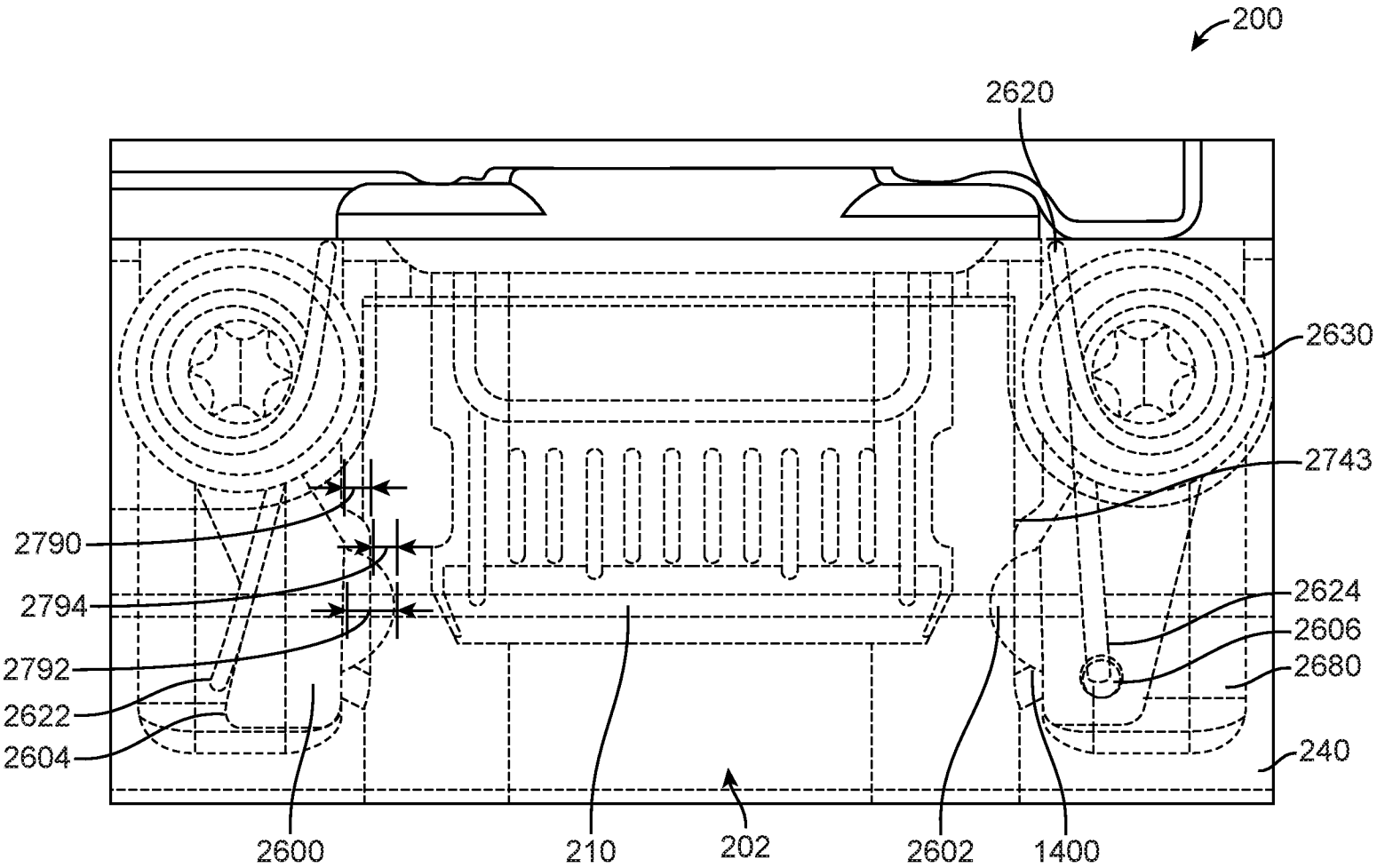
FIG. 27 is another transparent view of a connector receptacle according to an embodiment of the present invention.

FIG. 27 is another transparent view of a connector receptacle according to an embodiment of the present invention. In this example, connector receptacle 200 may include tongue 210 located in passage 202. Contacting portion 2602 of cam 2600 may be located in opening 1400. Opening 1400 may connect passage 202 to receptacle 2680. Fastener 2630 may secure spring 2620 and cam 2600 in place in device enclosure 240.

Again, spring 2620 may drive cam 2600 in various ways. In this example, portion 2624 of spring 2620 may fit in opening 2606 in cam 2600. Also in this example, portion 2622 of spring 2620 may push against a back surface 2604 of cam 2600.

Again, when a connector insert (not shown) is inserted into connector receptacle 200, side ground springs in the connector insert may engage notches 214 on tongue 210. This may provide a tactile response indicating that the connector insert has been mated with connector receptacle 200. Accordingly, to avoid confusion, it may be desirable to control the amount of tactile response provided contacting surface 2602 of cam 2600 encounters a shield of a connector insert.

This amount of tactile response may be controlled by controlling the amount of contacting surface 2602 of cam 2600 that extends into passage 202 in device enclosure 240. Specifically, walls 2743 between recesses 800 and passage 202 may have a thickness 2790. Contacting portion 2602 may have a depth 3792. Wall thickness 2790 and the depth 2792 of contacting portion 2602 may be controlled in order to accurately control a depth 2794 that contacting surface 2602 of cam 2600 extends into passage 202. Also, the force provided by spring 2620 may be controlled. In this way, a force provided by cam 2600 when a connector insert is inserted into connector receptacle 200 may be limited such that a confusing tactile response is not perceived before retention springs in the connector insert (not shown) engage notches 214 on tongue 210.

Figure 28:
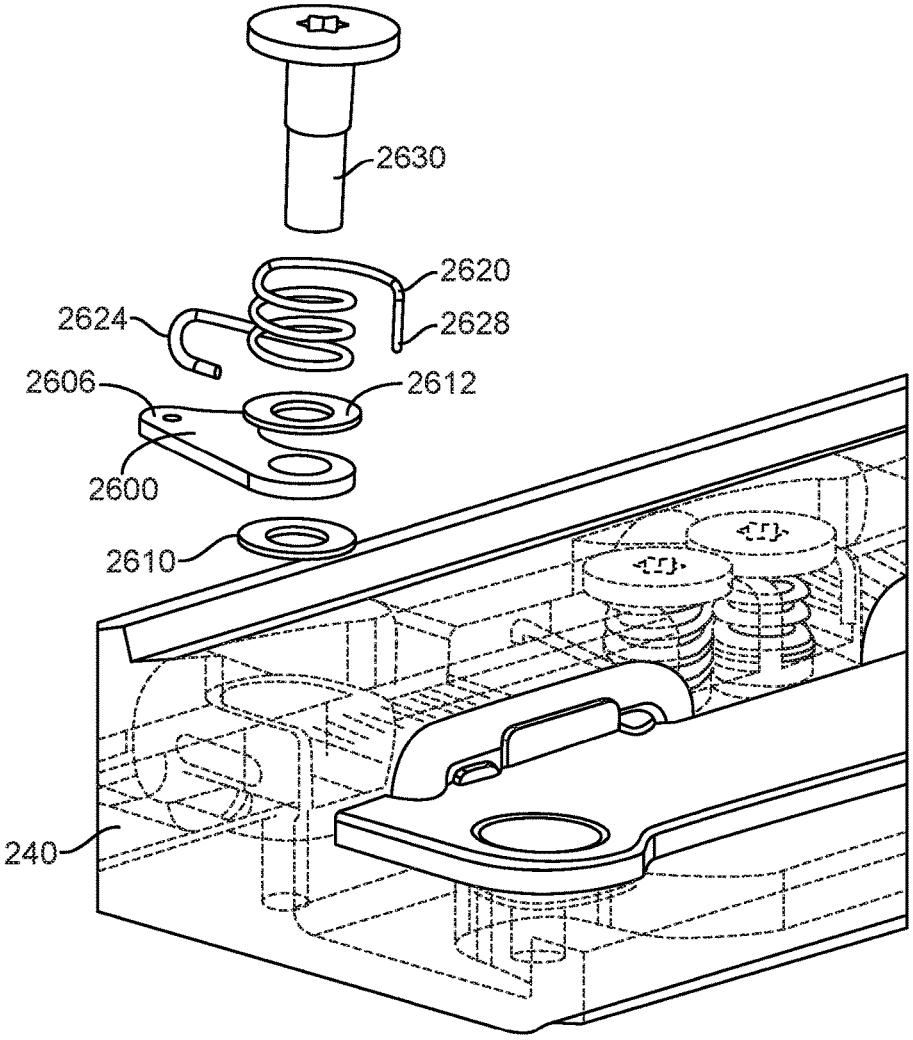
FIG. 28 is an exploded view of a portion of a connector receptacle according to an embodiment of the present invention.

FIG. 28 is an exploded view of a portion of a connector receptacle according to an embodiment of the present invention. In this example, cam 2600 may be isolated by washers 2610 and 2612. Spring 2620 may drive cam 2600. Fastener 2630 may secure spring 2620, cam 2600, and washers 2610 and 2612 together. Specifically, fastener 2630 may be inserted into an opening in device enclosure 240. Portion 2624 of spring 2620 may be inserted into opening 2606 of cam 2600 to provide a spring force on cam 2600. Tail portion 2628 of spring 2620 may be held in place against, or in, device enclosure 240.

Figure 29:
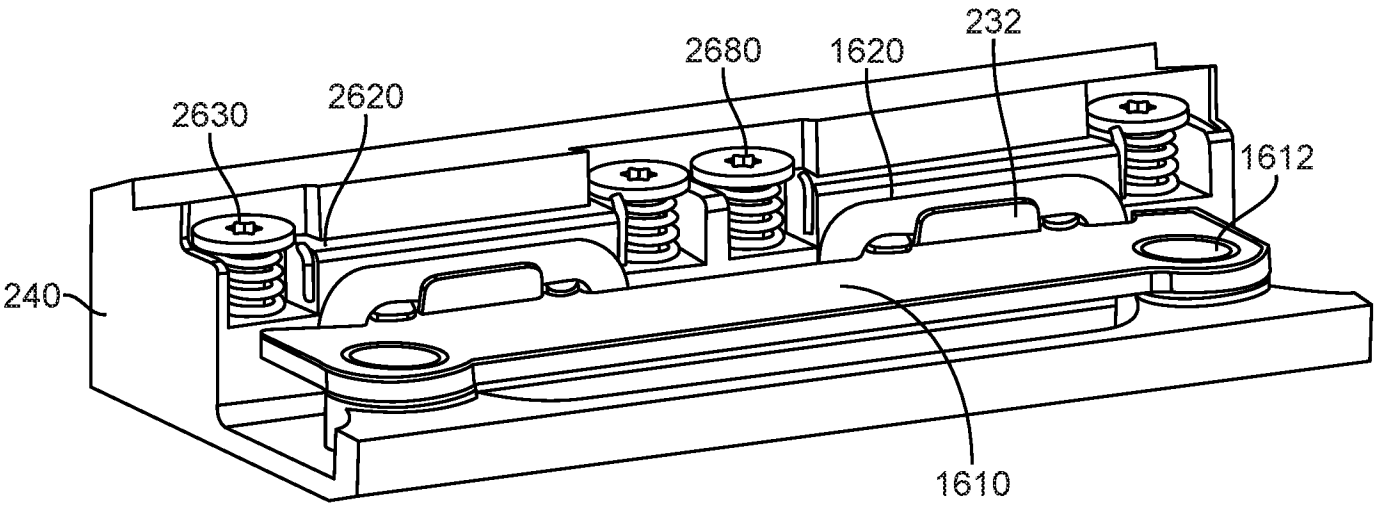
FIG. 29 illustrates an assembled pair of connector receptacles according to an embodiment of the present invention.

FIG. 29 illustrates an assembled pair of connector receptacles according to an embodiment of the present invention. In this example, springs 2620 may be held in place by fasteners 2630 in recesses 2680 in device enclosure 240. As before, O-ring 1620 may be held in place by ground tab 232. Board 1610 may be secured to device enclosure 240 by fasteners (not shown) located in openings 1612.

In other embodiments of the present invention, other types of ground springs may be employed. Examples are shown in the following figures.

Figure 30:
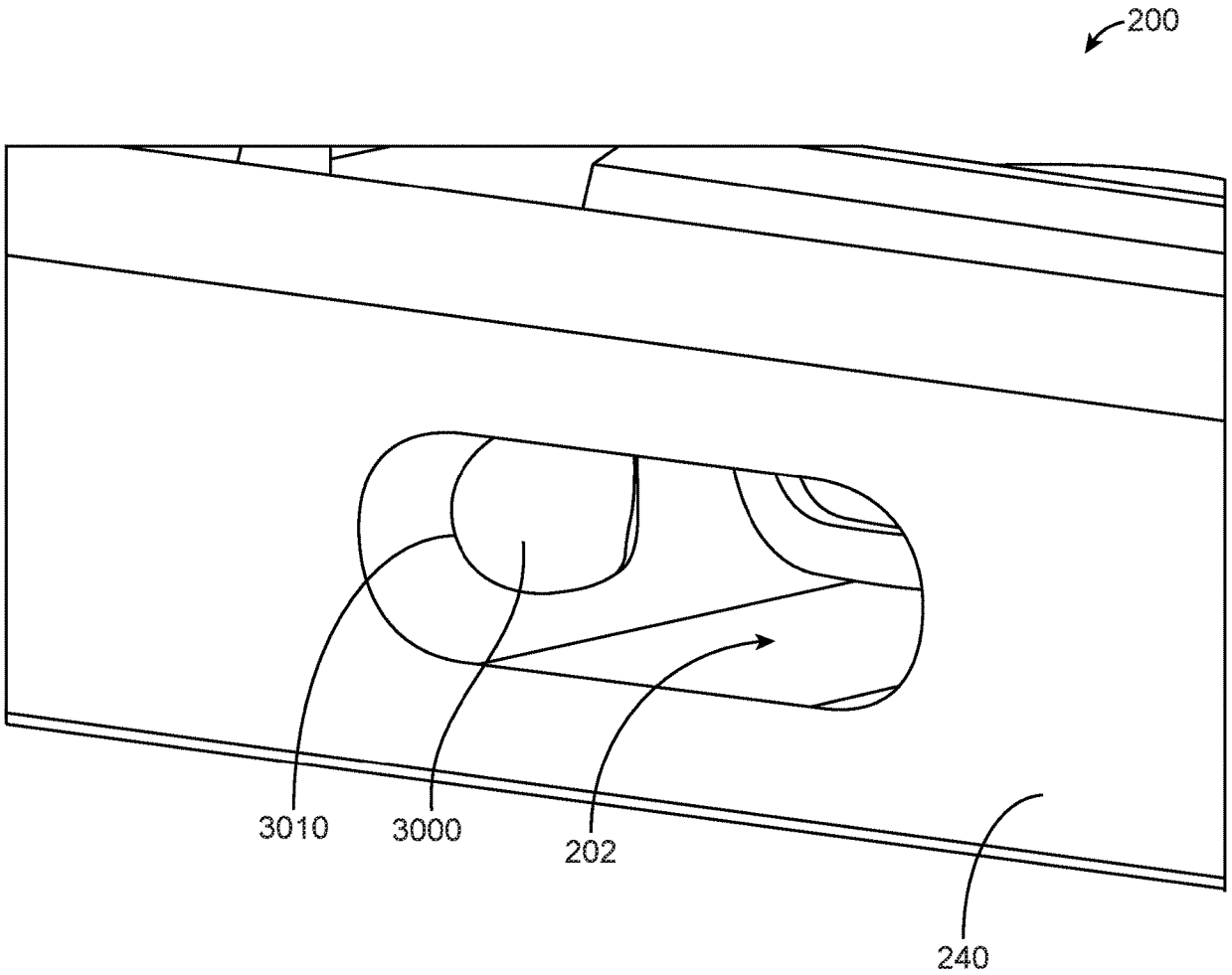
FIG. 30 is a front oblique view of a connector receptacle according to an embodiment of the present invention.

FIG. 30 is a front oblique view of a connector receptacle according to an embodiment of the present invention. In this example, connector receptacle 200 may include passage 202 in device enclosure 240. A ground spring may have a connecting portion 3000 exposed at opening 3010 in passage 202.

Figure 31:
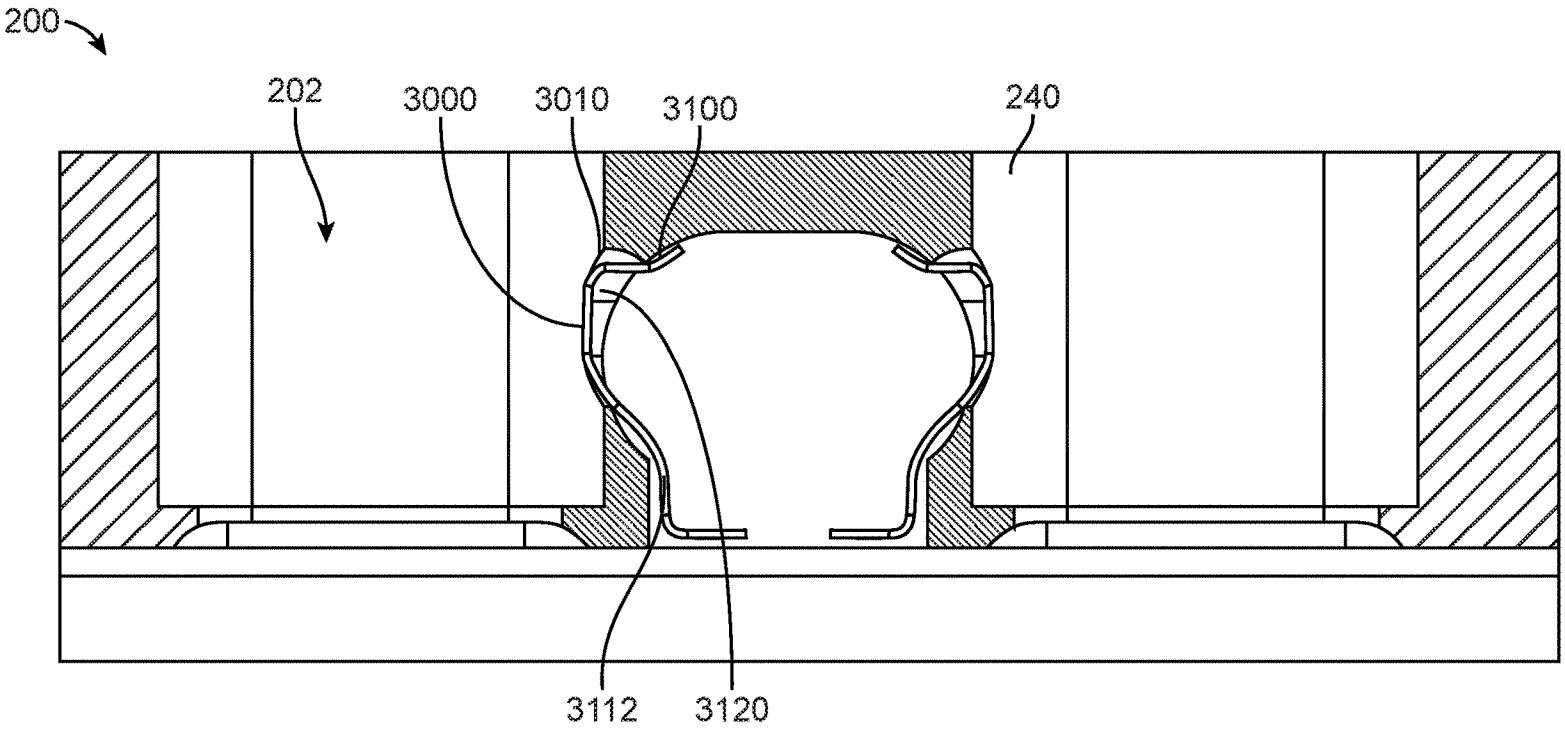
FIG. 31 illustrates a top away view of a pair of connector receptacles according to an embodiment of the present invention.

FIG. 31 illustrates a top away view of a pair of connector receptacles according to an embodiment of the present invention. In this example, ground springs 3100 may include contacting portions 3000. Contacting portion 3000 may be available at opening 3010 in passage 202 of device enclosure 240. Ground springs 3100 may include portion 3112 which may be located in device enclosure 240. Contacting portion 3000 of ground spring 3100 may be located in recess 3120, thereby allowing movement of contacting portion 3000.

Figure 32:
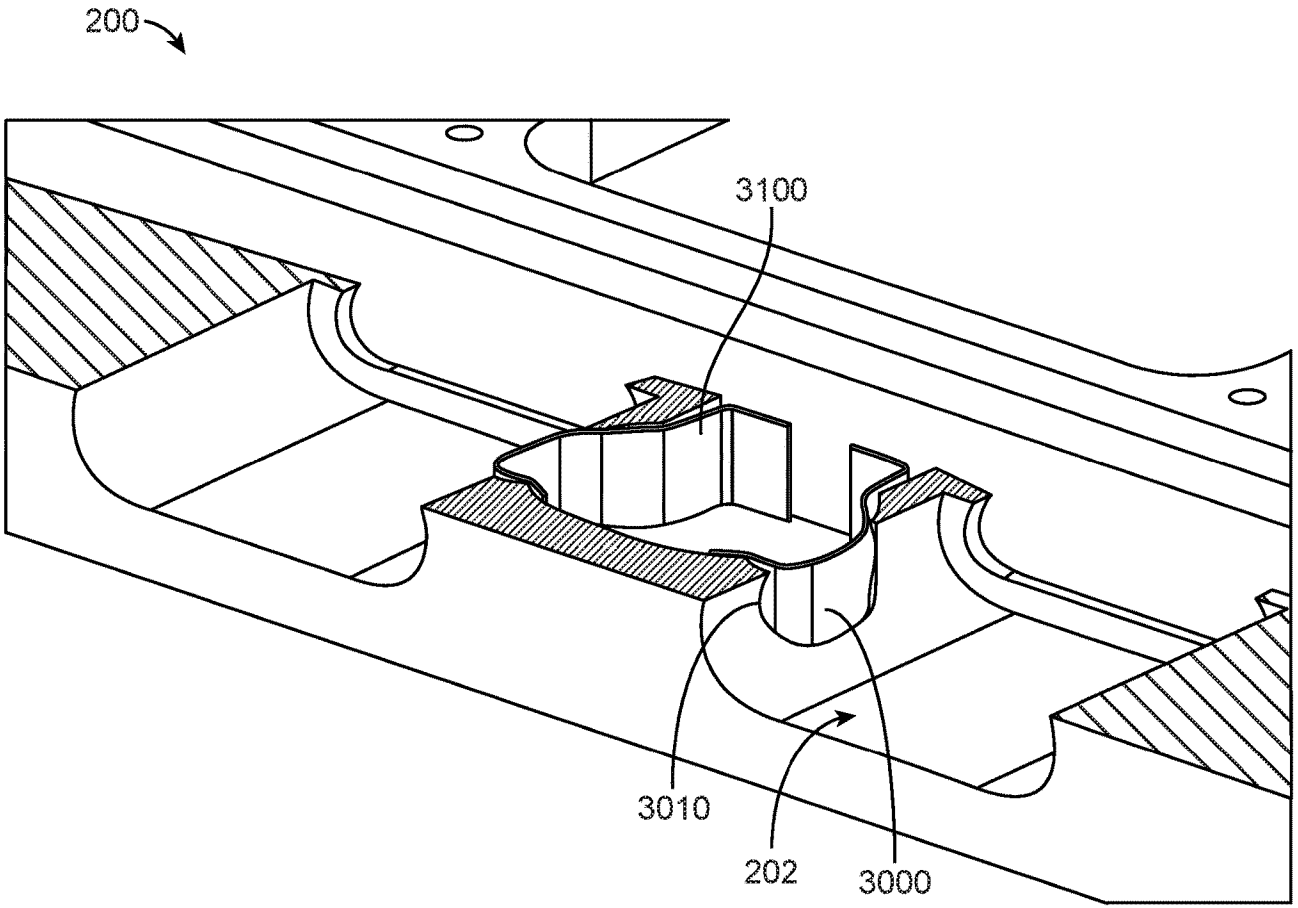
FIG. 32 illustrates an oblique cutaway view of a pair of connector receptacles according to an embodiment of the present invention.

FIG. 32 illustrates an oblique cutaway view of a pair of connector receptacles according to an embodiment of the present invention. Again, contacting portion 3000 of ground springs 3100 may be available at opening 3010 in passage 202 of connector receptacle 200.

In this example, ground springs may be located on one side of each connector receptacle 200. In these and other once the present invention, ground springs may be located on either or both lateral side of passage 202, in a top or bottom side, or both a top and bottom side of passage 202, or any combination thereof.

In various embodiments of the present invention, various structures such as spheres, tabs, trim rings, and others may be used as ground springs. These ground springs may form ground paths. When spheres are used, the spheres may be biased or held in place by one or more springs. An example is shown in the following figure.

Figure 33:
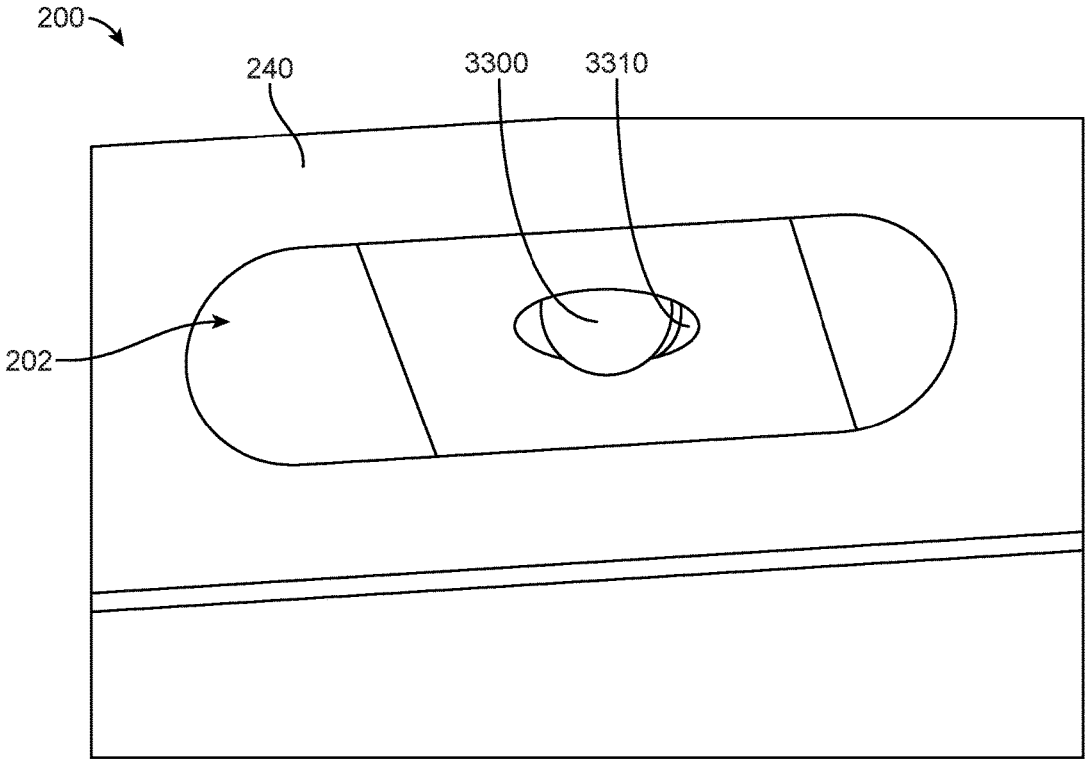
FIG. 33 illustrates a connector receptacle according to an embodiment of the present invention.

FIG. 33 illustrates a connector receptacle according to an embodiment of the present invention. In this example, sphere 3300 may be used as a ground spring and may be located in opening 3310 in a top of passage 202 in device enclosure 240. Sphere 3300 may be biased by one or more springs (not shown). Sphere 3300 may encounter a shield of a connector insert (not shown) when the connector insert is inserted into connector receptacle 200.

Figure 34:
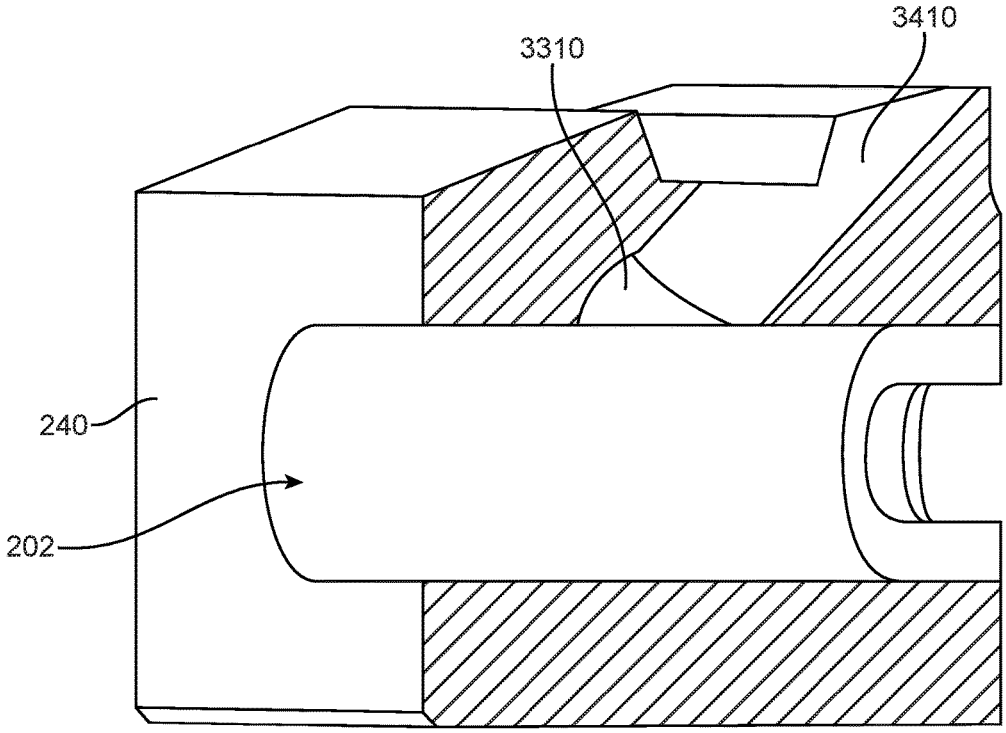
FIG. 34 illustrates a cutaway side view of a portion of a device enclosure according to an embodiment of the present invention.

FIG. 34 illustrates a cutaway side view of a portion of a device enclosure according to an embodiment of the present invention. In this example, opening 3310 may be at an end of recess 3410. Sphere 3300 may be located in recess 3310 and may be biased by a spring (not shown) located in recess 3410. Opening 3410 may lead to passage 202 in device enclosure 240.

Figure 35:
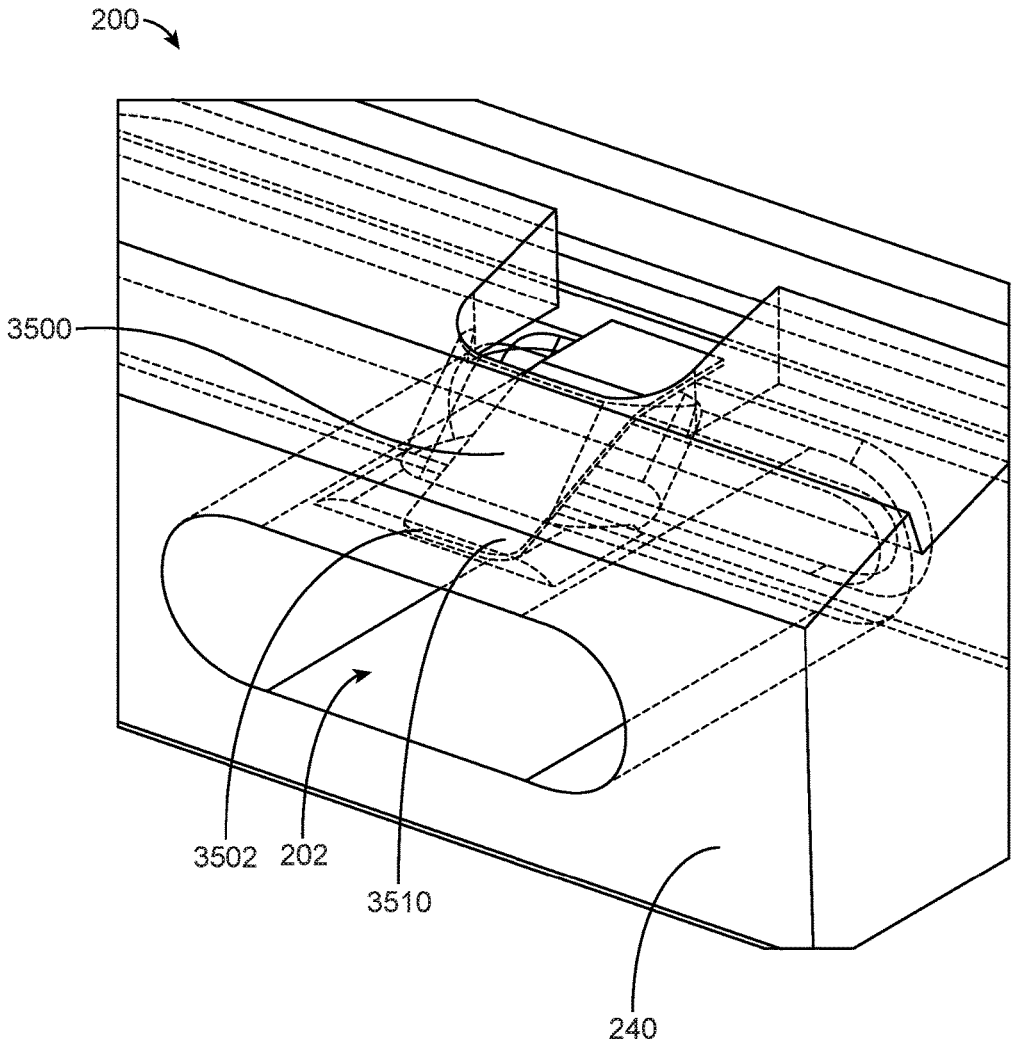
FIG. 35 illustrates a portion of a connector receptacle according to an embodiment of the present invention.

FIG. 35 illustrates a portion of a connector receptacle according to an embodiment of the present invention. In this example, connector receptacle 200 may include tab 3500 having a contacting portion 3502 available at opening 3510 in passage 202 in device enclosure 240. Tab 3500 may be used as a ground spring.

Figure 36:
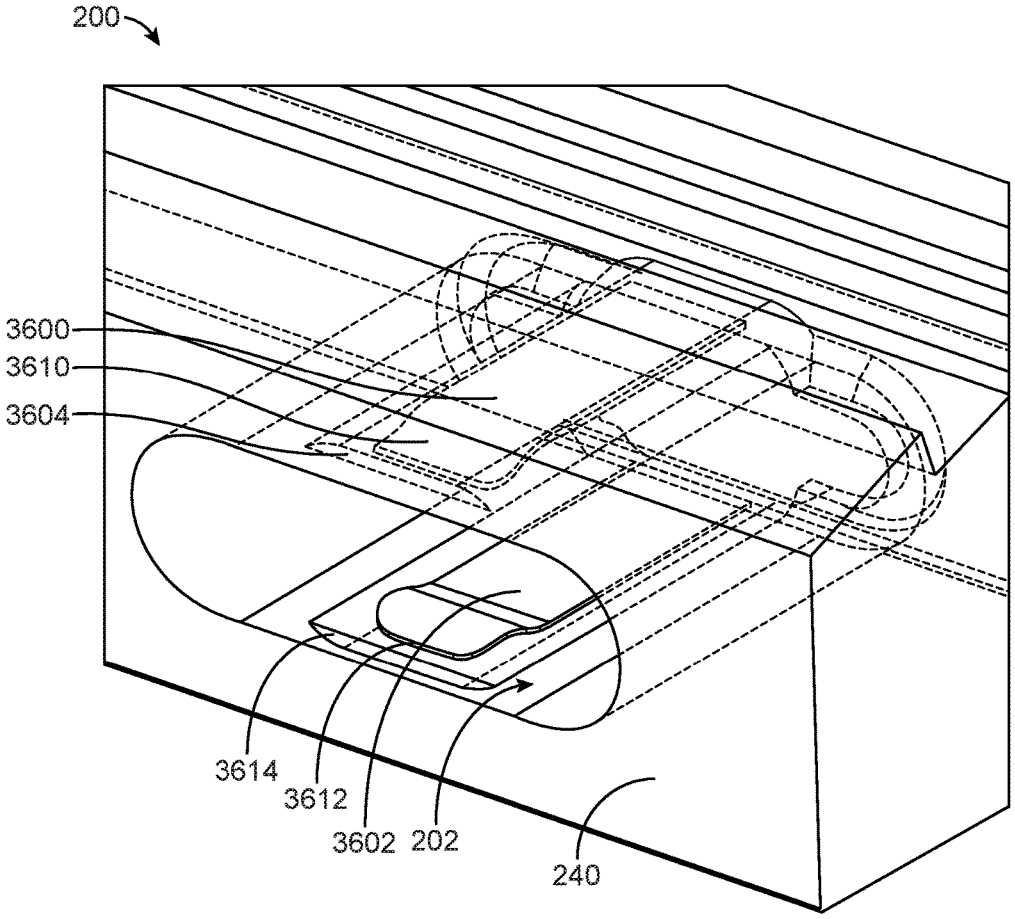
FIG. 36 illustrates a portion of a connector receptacle according to an embodiment of the present invention.

FIG. 36 illustrates a portion of a connector receptacle according to an embodiment of the present invention. In this example, connector receptacle 200 may include first and second tabs 3600 and 3602 having contacting portions 3610 and 3612 available at openings 3604 and 3614 in passage 202 in device enclosure 240. Tabs 3600 and 3602 may be used as ground springs.

Figure 37:
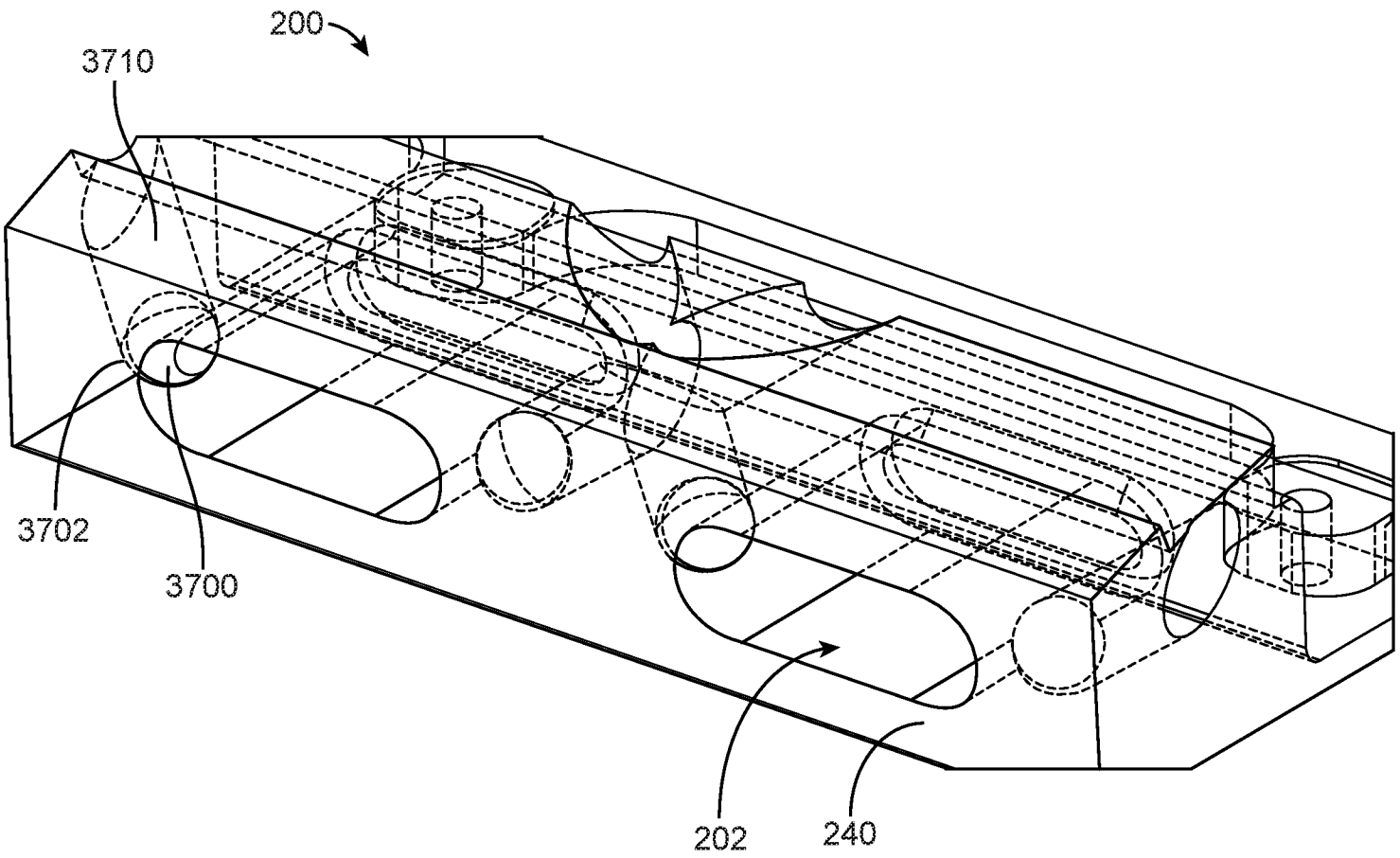
FIG. 37 illustrates a pair of connector receptacles according to an embodiment of the present invention.

FIG. 37 illustrates a pair of connector receptacles according to an embodiment of the present invention. In this example, connector receptacles 200 may include spheres 3700 that may be used as ground springs and that may be located at openings 3702 in passage 202 in device enclosure 240. Springs (not shown) may be located in recesses 3710 to hold spheres 3700 in position.

Figure 38:
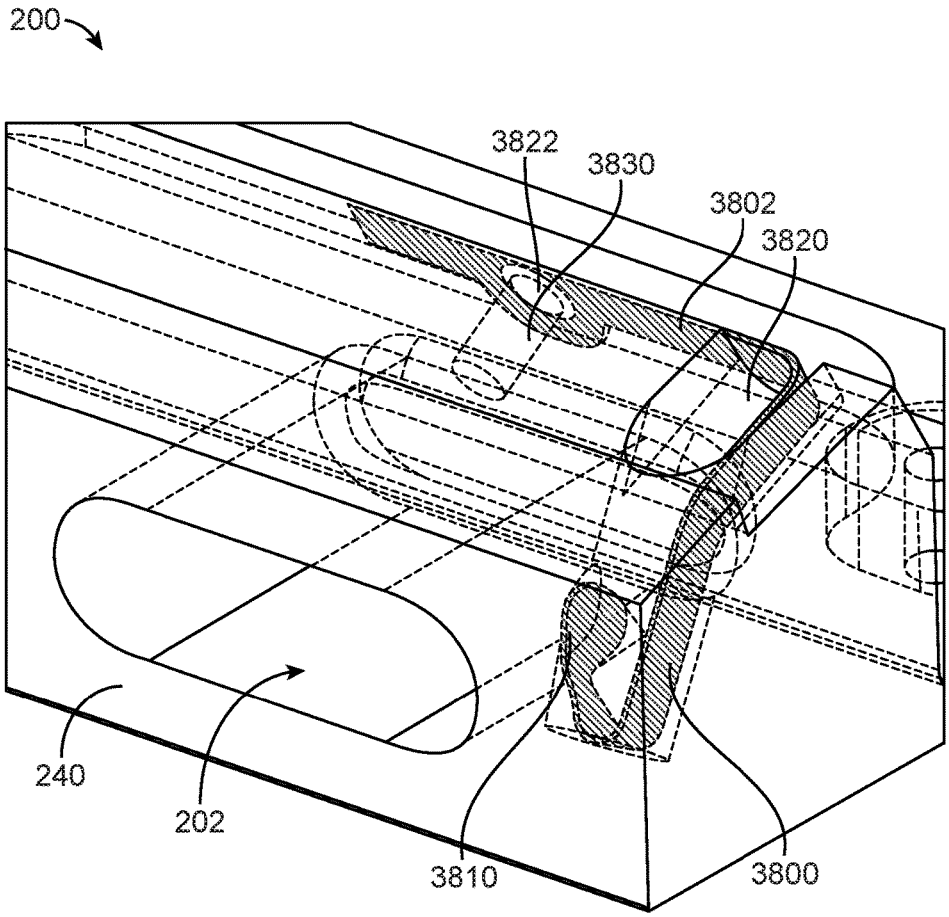
FIG. 38 illustrates a connector receptacle according to an embodiment of the present invention.

FIG. 38 illustrates a connector receptacle according to an embodiment of the present invention. Connector receptacle 200 may include tongue 210 (shown in FIG. 3) in passage 202 of device enclosure 240. In this example, ground spring 3800 may have contacting portion 3010 located in an opening (not shown) in passage 202 of a device enclosure 240. Ground spring 3800 may be located in recess 3820 in device enclosure 240. Ground spring 3800 may further include lateral arm 3802 which may have opening 3822. A fastener (not shown) may pass through opening 3822 into recess 3830 to secure ground spring 3800 to device enclosure 240.

Figure 39:
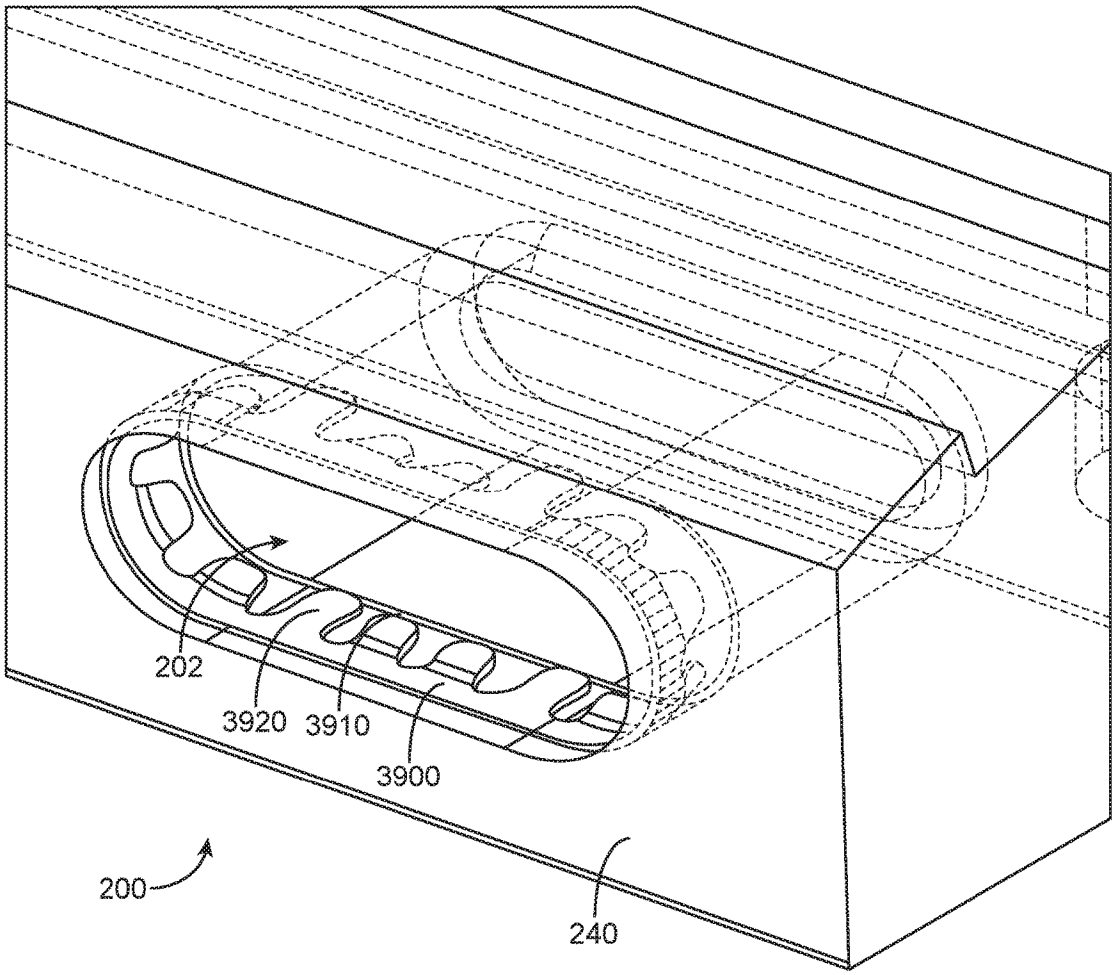
FIG. 39 illustrates a connector receptacle according to an embodiment of the present invention.

FIG. 39 illustrates a connector receptacle according to an embodiment of the present invention. In this example, connector receptacle 200 may include trim ring 3900 near a front opening of passage 202 in device enclosure 240, where trim ring 3900 may be used as a ground spring. Trim ring 3900 may include tabs 3920 biased towards a surface of passage 202 for holding trim ring 3900 in place. Trim ring 3900 may further include tabs 3910, which may be biased away from a surface of passage 202 in order to form an electrical connection with a shield on a connector insert (not shown) when the connector insert is inserted into connector receptacle 200. Trim ring 3900 may be formed of sheet metal, conductive foam, silicone, or other material.

Figure 40:
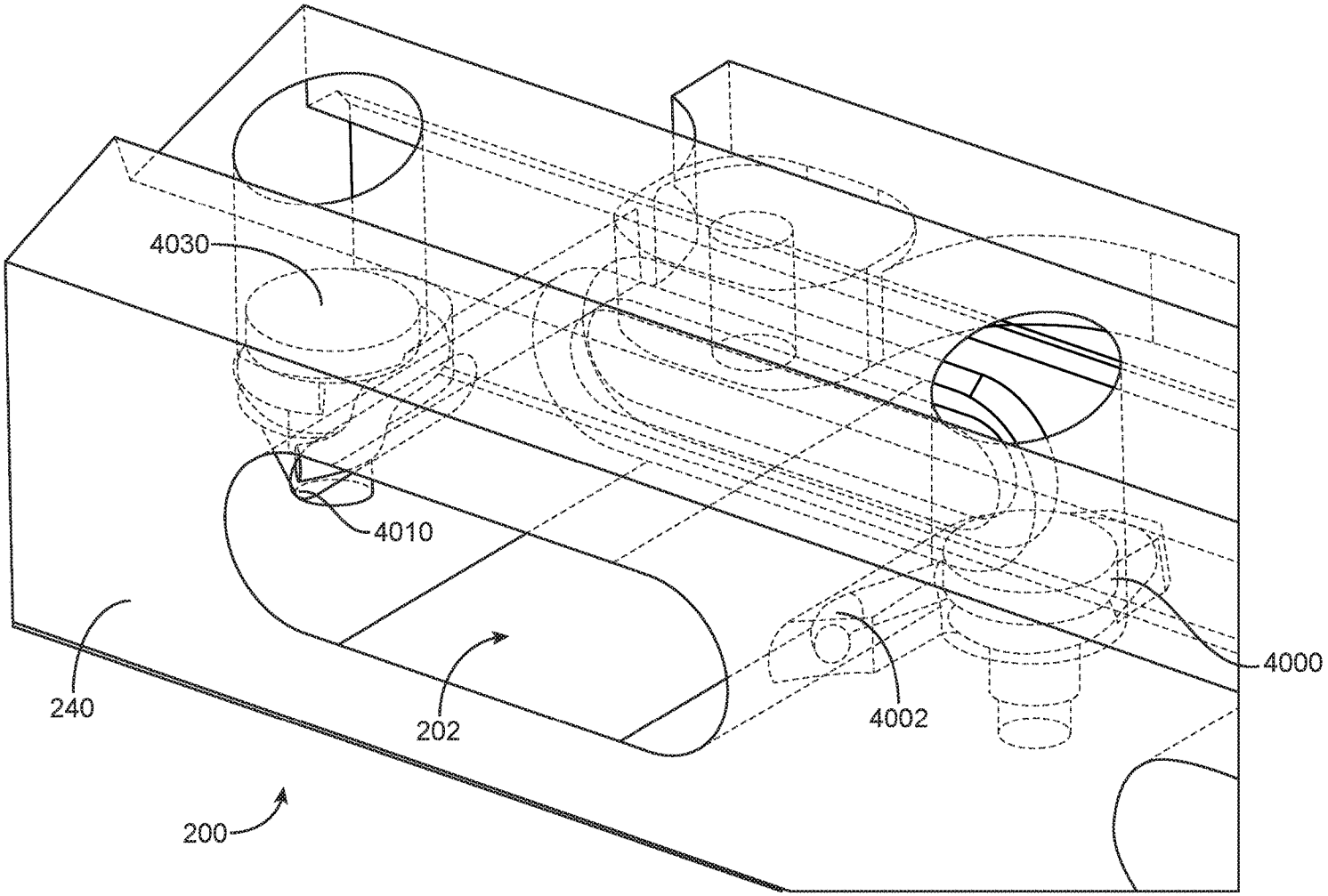
FIG. 40 illustrates a connector receptacle according to an embodiment of the present invention.

FIG. 40 illustrates a connector receptacle according to an embodiment of the present invention. In this example, wire forms or torsion springs 4000 be used as ground springs and may have contacting portions 4002 in openings 4010 in passage 202 in device enclosure 240. Fasteners 4030 may be used to secure torsion spring 4000 in place in connector receptacle 200.

While embodiments of the present invention may be useful in USB Type-C connector receptacles, these and other embodiments of the present invention may be used in other types of connector receptacles for different interfaces.

In various embodiments of the present invention, ground springs, ground contacts, device enclosures (when conductive), and other conductive portions of a connector receptacle may be formed by stamping, metal-injection molding, machining, micro-machining, 3-D printing, or other manufacturing process. The conductive portions may be formed of aluminum, ceramic, stainless steel, steel, copper, copper titanium, phosphor bronze, or other material or combination of materials. They may be plated or coated with nickel, gold, or other material. The device enclosures (when nonconductive), housings, and other nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The printed circuit boards, for example those used to form the tongues and boards, may be formed of FR-4 or other material.

Embodiments of the present invention may provide connector receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, remote control devices, chargers, and other devices. These connector receptacles may provide interconnect pathways for signals that are compliant with various standards such as one of the Universal Serial Bus standards including USB Type-C, High-Definition Multimedia Interface, Digital Visual Interface, Ethernet, DisplayPort, Thunderbolt, Lightning, Joint Test Action Group, test-access-port, Directed Automated Random Testing, universal asynchronous receiver/transmitters, clock signals, power signals, and other types of standard, non-standard, and proprietary interfaces and combinations thereof that have been developed, are being developed, or will be developed in the future. Other embodiments of the present invention may provide connector receptacles that may be used to provide a reduced set of functions for one or more of these standards. In various embodiments of the present invention, these interconnect paths provided by these connector receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. An electronic device comprising:

a device enclosure;

a passage in the device enclosure extending from a surface of the electronic device to an interior of the electronic device;

a connector receptacle tongue in the passage;

a first recess on a first side of the tongue and extending into the device enclosure, a first opening connecting the first recess and the passage;

a second recess on a second side of the tongue and extending into the device enclosure, a second opening connecting the second recess and the passage;

a first ground spring located in the first recess; and a second ground spring located in the second recess.

2. The electronic device of claim 1 wherein the first recess is at an oblique angle to the passage, and the second recess is at an oblique angle to the passage and parallel to the first recess.

3. The electronic device of claim 2 wherein the first ground spring and the second ground spring each comprise a first open-tube portion, a section of the first open-tube portion of the first ground spring located in the first opening and a section of the first open-tube portion of the second ground spring located in the second opening.

4. The electronic device of claim 3 wherein when a connector insert is mated with the connector receptacle tongue, the first ground spring electrically connects to a shield of the connector insert before a ground contact of the connector insert electrically connects to a signal contact on the connector receptacle tongue.

5. The electronic device of claim 3 wherein the first ground spring and the second ground spring each further comprise a second open-tube portion joined to the first open-tube portion by a U-shaped portion.

6. The electronic device of claim 3 wherein the connector receptacle tongue is a connector receptacle tongue for a Universal Serial Bus Type-C connector receptacle.

7. The electronic device of claim 1 wherein the first ground spring and the second ground spring each comprise a first open-tube portion having a lance, the lance of the first ground spring located in the first opening and the lance of the second ground spring located in the second opening.

8. The electronic device of claim 7 wherein the first ground spring and the second ground spring each further comprise a raised portion, the raised portion of the first ground spring in a notch in the first recess and, the raised portion of the second ground spring in a notch in the second recess.

9. An electronic device comprising:

a device enclosure;

a passage in the device enclosure extending from a surface of the electronic device to an interior of the electronic device;

a connector receptacle tongue in the passage;

a first recess on a first side of the tongue and extending into the device enclosure at an oblique angle to the passage, a first opening connecting the first recess and the passage;

a second recess on a second side of the tongue and extending into the device enclosure at an oblique angle to the passage and parallel to the first recess, a second opening connecting the second recess and the passage; and a ground spring having a first arm in the first recess, a second arm in the second recess, and a joining piece connecting the first arm and the second arm.

10. The electronic device of claim 9 wherein the first arm of the ground spring comprises a lance located in the first opening and the second arm of the ground spring comprises a lance located in the second opening.

11. The electronic device of claim 10 wherein the ground spring further comprises a tab on the joining piece, the tab at a right angle to the joining piece, the tab to fit in a notch in the device enclosure.

12. The electronic device of claim 11 further comprising a piece of conductive foam between the joining piece of the ground spring and an inside surface of the device enclosure.

13. The electronic device of claim 12 wherein the connector receptacle tongue further comprises a ground contact having an angled tab, the electronic device further comprising a conductive foam ring around the connector receptacle tongue and between the angled tab on the ground contact and the ground spring.

14. The electronic device of claim 10 wherein the connector receptacle tongue is a connector receptacle tongue for a Universal Serial Bus Type-C connector receptacle.

15. An electronic device comprising:

a device enclosure;

a passage in the device enclosure extending from a surface of the electronic device to an interior of the electronic device;

a connector receptacle tongue in the passage;

a first recess on a first side of the tongue and extending into the device enclosure, a first opening connecting the first recess and the passage;

a second recess on a second side of the tongue and extending into the device enclosure, a second opening connecting the second recess the passage; and a ground spring having a first arm in the first recess and having a contacting portion in the first opening, a second arm in the second recess and having a contacting portion in the second opening, and a joining piece connecting the first arm and the second arm.

16. The electronic device of claim 15 wherein when a connector insert is mated with the connector receptacle tongue, the contacting portion of the first arm of the ground spring electrically connects to a shield of the connector insert.

17. The electronic device of claim 16 wherein when the connector insert is mated with the connector receptacle tongue, the contacting portion of the first arm of the ground spring electrically connects to the shield of the connector insert before a ground contact of the connector insert electrically connects to a signal contact on the connector receptacle tongue.

18. The electronic device of claim 16 wherein the first recess is at an oblique angle to the passage and the second recess is at an oblique angle to the passage and parallel to the first recess.

19. The electronic device of claim 15 wherein the contacting portions of the first and second arms of the ground spring are lances.

20. The electronic device of claim 15 wherein the connector receptacle tongue is a connector receptacle tongue for a Universal Serial Bus Type-C connector receptacle.

* * * * *